US010302343B2

(12) United States Patent
Yoshikawa et al.

(10) Patent No.: US 10,302,343 B2
(45) Date of Patent: May 28, 2019

(54) DEFROST SYSTEM FOR REFRIGERATION APPARATUS, AND COOLING UNIT

(71) Applicant: MAYEKAWA MFG. CO., LTD., Tokyo (JP)

(72) Inventors: Choiku Yoshikawa, Tokyo (JP); Makoto Sano, Tokyo (JP); Iwao Terashima, Tokyo (JP); Daiki Kayashima, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 401 days.

(21) Appl. No.: 14/767,635

(22) PCT Filed: Nov. 25, 2014

(86) PCT No.: PCT/JP2014/081042
§ 371 (c)(1),
(2) Date: Aug. 13, 2015

(87) PCT Pub. No.: WO2015/093233
PCT Pub. Date: Jun. 25, 2015

(65) Prior Publication Data

US 2015/0377541 A1 Dec. 31, 2015

(30) Foreign Application Priority Data

Dec. 17, 2013 (JP) ..... 2013-259751

(51) Int. Cl.
*F25D 21/06* (2006.01)
*F25B 47/02* (2006.01)
(Continued)

(52) U.S. Cl.
CPC ..... *F25B 47/02* (2013.01); *F25B 1/10* (2013.01); *F25B 7/00* (2013.01); *F25B 9/00* (2013.01);
(Continued)

(58) Field of Classification Search
CPC .... F25B 47/02; F25B 1/10; F25B 9/00; F25B 9/008; F25B 41/00; F25B 41/04;
(Continued)

(56) References Cited

U.S. PATENT DOCUMENTS 3,084,519 A 4/1963 Hanson et al.
3,228,204 A 1/1966 Matthies
(Continued)

FOREIGN PATENT DOCUMENTS

CA 2662986 A1 10/2009
DE 2503303 A1 8/1975
(Continued)

OTHER PUBLICATIONS

Translation of JP2013124812A, retrieved on Oct. 13, 2018.*
(Continued)

*Primary Examiner* — Keith M Raymond
*Assistant Examiner* — Kamran Tavakoldavani
(74) *Attorney, Agent, or Firm* — Rossi, Kimms & McDowell LLP

(57) ABSTRACT

A defrost system is disclosed that includes a cooling device disposed in a freezer, a heat exchanger pipe leading into a casing, a drain receiver unit; a refrigerating device for cooling and liquefying $CO_2$ refrigerant; a refrigerant circuit for permitting the $CO_2$ refrigerant to circulate to the heat exchanger pipe; a defrost circuit branched from the heat exchanger pipe forming a $CO_2$ circulation path with the heat exchanger pipe; an on-off valve so that the $CO_2$ circulation path becomes a closed circuit; a pressure adjusting unit for adjusting the pressure of the $CO_2$ refrigerant; and a first heat exchanger unit for heating the $CO_2$ refrigerant circulating with brine, disposed below the cooling device to which the defrost circuit and a first brine circuit in which brine, a first heating medium, circulates, are led, in which the $CO_2$
(Continued)

refrigerant naturally circulates in the closed circuit when defrosting by a thermosiphon effect.

11 Claims, 10 Drawing Sheets

(51) Int. Cl.

| | |
|---|---|
| ***F25D 17/02*** | (2006.01) |
| ***F25B 1/10*** | (2006.01) |
| ***F25B 7/00*** | (2006.01) |
| ***F25D 21/10*** | (2006.01) |
| ***F25B 9/00*** | (2006.01) |
| ***F25B 41/00*** | (2006.01) |
| ***F25B 41/04*** | (2006.01) |
| ***F25B 49/02*** | (2006.01) |
| ***F25D 21/12*** | (2006.01) |
| ***F25D 21/14*** | (2006.01) |
| *F25B 25/00* | (2006.01) |
| *F25B 23/00* | (2006.01) |

(52) U.S. Cl.
CPC ..... *F25B 9/008* (2013.01); *F25B 41/00* (2013.01); *F25B 41/04* (2013.01); *F25B 49/02* (2013.01); *F25D 17/02* (2013.01); *F25D 21/10* (2013.01); *F25D 21/12* (2013.01); *F25D 21/14* (2013.01); *F25B 23/006* (2013.01); *F25B 25/00* (2013.01); *F25B 2339/047* (2013.01); *F25B 2347/022* (2013.01); *F25B 2400/072* (2013.01); *F25B 2400/13* (2013.01)

(58) Field of Classification Search
CPC .... F25B 49/02; F25B 23/006; F25B 2347/02; F25B 2347/022; F25B 2600/2519; F25B 7/00; F25B 25/005; F25D 17/02; F25D 21/12; F25D 21/10; F25D 21/14
See application file for complete search history.

(56) References Cited

U.S. PATENT DOCUMENTS

| | | | | |
|---|---|---|---|---|
| 4,037,427 | A * | 7/1977 | Kramer | F25D 21/02 340/581 |
| 6,170,270 | B1 | 1/2001 | Arshansky et al. | |
| 7,698,902 | B2 | 4/2010 | Kang et al. | |
| 7,992,397 | B2 | 8/2011 | Nemoto et al. | |
| 9,377,236 | B2 * | 6/2016 | Hinde | F25B 1/10 |
| 2004/0168462 | A1 * | 9/2004 | Assaf | F24F 3/1417 62/271 |
| 2006/0266058 | A1 * | 11/2006 | Nemoto | F25B 9/002 62/183 |
| 2007/0234753 | A1 | 10/2007 | Nemoto et al. | |
| 2009/0223232 | A1 * | 9/2009 | Rolfsman | F25B 47/02 62/80 |
| 2009/0260389 | A1 | 10/2009 | Dube | |
| 2011/0083462 | A1 * | 4/2011 | Engelhart | F24D 3/08 62/324.1 |
| 2012/0055182 | A1 | 3/2012 | Dube | |
| 2012/0055185 | A1 | 3/2012 | Luo et al. | |
| 2013/0098078 | A1 | 4/2013 | Contreras Lafaire et al. | |
| 2014/0260361 | A1 | 9/2014 | Rodier | |
| 2014/0352343 | A1 | 12/2014 | Hinde et al. | |
| 2015/0204589 | A1 | 7/2015 | Liu | |

FOREIGN PATENT DOCUMENTS

| | | | | |
|---|---|---|---|---|
| DE | 29817062 | U1 | 4/1999 | |
| DE | 102004007932 | A1 * | 9/2004 | F25B 5/02 |
| EP | 1630495 | A1 | 3/2006 | |
| JP | 5244468 | U | 3/1977 | |
| JP | 52131652 | U | 10/1977 | |
| JP | 2001027473 | A | 1/2001 | |
| JP | 2003021365 | A | 1/2003 | |
| JP | 2003329334 | A | 11/2003 | |
| JP | 2004170007 | A | 6/2004 | |
| JP | 4197562 | B2 | 10/2008 | |
| JP | 2010181093 | A | 8/2010 | |
| JP | 2012072981 | A | 4/2012 | |
| JP | 2013124812 | A * | 6/2013 | |
| JP | 2013124812 | A * | 6/2013 | |
| JP | 2013160427 | A | 8/2013 | |
| JP | 5316973 | B2 | 10/2013 | |
| KR | 2019940008247 | U | 4/1994 | |
| KR | 1020110021128 | A | 3/2011 | |
| WO | 2006049355 | A1 | 5/2006 | |
| WO | 2008112554 | A1 | 9/2008 | |
| WO | 2009034300 | A1 | 3/2009 | |

OTHER PUBLICATIONS

JP 2013124812 A is attached as FOR, and Translation of JP 2013124812 A is attached as NPL and.*
Notice of Allowance issued in U.S. Appl. No. 14/903,870 dated Jun. 16, 2017.
Scientific & Technical Information Center (STIC) EIC 3700 Search Report—dated Jun. 2017. Cited in NPL 1.
International Search Report issued in PCT/JP2014/081042, dated Feb. 24, 2015. English translation provided.
Written Opinion issued in PCT/JP2014/081042, dated Feb. 24, 2015.
International Preliminary Report on Patentability issued in Intl. Appln. No. PCT/JP2014/081042 dated Jun. 21, 2016. English translation provided.
International Preliminary Report on Patentability issued in Intl. Appln. No. PCT/JP2014/081043 dated Jun. 21, 2016. English translation provided.
International Preliminary Report on Patentability issued in Intl. Appln. No. PCT/JP2014/081044 dated Jun. 21, 2016. English translation provided.
International Search Report issued in PCT/JP2014/081043 dated Feb. 24, 2015. English translation provided.
Written Opinion issued in PCT/JP2014/081043 dated Feb. 24, 2015.
International Search Report issued in PCT/JP2014/081044, dated Feb. 24, 2015. English translation provided.
Written Opinion issued in PCT/JP2014/081044, dated Feb. 24, 2015.
Extended European Search Report issued in European Appln. No. 14873060.9, dated Oct. 28, 2016.
Extended European Search Report issued in European Appln. No. 14871996.6, dated Oct. 28, 2016.
Office Action issued in Korean Appln. No. 10-2016-7019058 dated Apr. 10, 2017. English translation provided.
Office Action issued in Korean Appln. No. 10-2016-7019012 dated Apr. 10, 2017. English translation provided.
Office Action issued in Korean Appln. No. 10-2016-7018741 dated Apr. 10, 2017. English translation provided.
Notice of Allowance issued in U.S. Appl. No. 14/904,283 dated Sep. 28, 2017.
Office Action issued in European Appln. No. 14872847.0 dated Jan. 19, 2018.
Extended European Search Report issued in European Application No. 17166281.0 dated Dec. 13, 2017.
Extended European Search Report issued in European Application No. 17190161.4 dated Jan. 22, 2018.
Ofice Action issued in Mexican Appln. No. 2015011265 dated May 21, 2018. Partial English translation provided.

* cited by examiner

DEFROST SYSTEM FOR REFRIGERATION APPARATUS, AND COOLING UNIT

TECHNICAL FIELD

The present disclosure relates to a defrost system applied to a refrigeration apparatus which cools the inside of a freezer by permitting $CO_2$ refrigerant to circulate in a cooling device disposed in the freezer, for removing frost attached to a heat exchanger pipe disposed in the cooling device, and relates to a cooling unit that can be applied to the defrost system.

BACKGROUND

To prevent the ozone layer depletion, global warming, and the like, natural refrigerants such as $NH_3$ or $CO_2$ has been reviewed as refrigerant in a refrigeration apparatus used for room air conditioning and refrigerating food products. Thus, refrigeration apparatuses using $NH_3$, with high cooling performance and toxicity, as a primary refrigerant and using $CO_2$, with no toxicity or smell, as a secondary refrigerant have been widely used.

In the refrigeration apparatus, a primary refrigerant circuit and a secondary refrigerant circuit are connected to each other through a cascade condenser. Heat exchange between the $NH_3$ refrigerant and the $CO_2$ refrigerant takes place in the cascade condenser. The $CO_2$ refrigerant cooled and liquefied with the $NH_3$ refrigerant is sent to a cooling device disposed in the freezer, and cools air in the freezer through a heat transmitting pipe disposed in the cooling device. The $CO_2$ refrigerant partially vaporized therein returns to the cascade condenser through the secondary refrigerant circuit, to be cooled and liquefied again in the cascade condenser.

Frost attaches to a heat exchanger pipe disposed in the cooling device while the refrigeration apparatus is under operation, and thus the heat transmission efficiency degrades. Thus, the operation of the refrigeration apparatus needs to be periodically stopped, to perform defrosting.

Conventional defrosting methods for the heat exchanger pipe disposed in the cooling device include a method of spraying water onto the heat exchanger pipe, a method of heating the heat exchanger pipe with an electric heater, and the like. The defrosting by spraying water ends up producing a new source of frost, and the heating by the electric heater is against an attempt to save power because valuable power is wasted. In particular, the defrosting by spraying water requires a tank with a large capacity and water supply and discharge pipes with a large diameter, and thus increases plant construction cost.

Patent Documents 1 and 2 disclose a defrost system for the refrigeration apparatus described above. A defrost system disclosed in Patent Document 1 is provided with a heat exchanger unit which vaporizes the $CO_2$ refrigerant with heat produced in the $NH_3$ refrigerant, and achieves the defrosting by permitting $CO_2$ hot gas generated in the heat exchanger unit to circulate in the heat exchanger pipe in the cooling device.

A defrost system disclosed in Patent Document 2 is provided with a heat exchanger unit which heats the $CO_2$ refrigerant with cooling water that has absorbed exhaust heat from the $NH_3$ refrigerant, and achieves the defrosting by permitting the heated $CO_2$ refrigerant to circulate in the heat exchanger pipe in the cooling device.

Patent Documents 1 and 2 disclose a defrost system for the refrigeration apparatus described above. A defrost system disclosed in Patent Document 1 is provided with a heat exchanger unit which vaporizes the $CO_2$ refrigerant with heat produced in the $NH_3$ refrigerant, and achieves the defrosting by permitting $CO_2$ hot gas generated in the heat exchanger unit to circulate in the heat exchanger pipe in the cooling device.

A defrost system disclosed in Patent Document 2 is provided with a heat exchanger unit which heats the $CO_2$ refrigerant with cooling water that has absorbed exhaust heat from the $NH_3$ refrigerant, and achieves the defrosting by permitting the heated $CO_2$ refrigerant to circulate in the heat exchanger pipe in the cooling device.

Patent Document 3 discloses a method of providing a heating tube in the cooling device separately and independently from a cooling tube, and melts and removes the frost attached to the cooling tube by permitting warm water or warm brine to flow in the heating tube at the time of a defrosting operation.

CITATION LIST

Patent Literature

Patent Document 1: Japanese Patent Application Laid-open No. 2010-181093

Patent Document 2: Japanese Patent Application Laid-open No. 2013-124812

Patent Document 3: Japanese Patent Application Laid-open No. 2003-329334

SUMMARY

Technical Problem

Each of the defrost systems disclosed in Patent Documents 1 and 2 requires the pipes for the $CO_2$ refrigerant and the $NH_3$ refrigerant in a system different from the cooling system to be constructed at the installation site, and thus might increase the plant construction cost. The heat exchanger unit is separately installed outside the freezer, and thus an extra space for installing the heat exchanger unit is required.

In the defrost system in Patent Document 2, a pressurizing/depressurizing adjustment unit is required to prevent thermal shock (sudden heating/cooling) in the heat exchanger pipe. To prevent the heat exchanger unit where the cooling water and the $CO_2$ refrigerant exchange heat from freezing, an operation of discharging the cooling water in the heat exchanger unit needs to be performed after the defrosting operation is terminated. Thus, there is a problem in that, for example, an operation is complicated.

The defrost unit disclosed in Patent Document 3 requires the heating tube, and thus the size of the heat exchanger unit of the cooling device is large and a heat source for heating the warm water and the warm brine is required. Furthermore, the defrost unit has a problem in that the heat transmission efficiency is low because the cooling tube is heated from the outside with plate fins and the like.

In a cascade refrigerating device including: a primary refrigerant circuit in which the $NH_3$ refrigerant circulates and a refrigerating cycle component is provided; and a secondary refrigerant circuit in which the $CO_2$ refrigerant circulates and a refrigerating cycle component is disposed, the secondary refrigerant circuit being connected to the primary refrigerant circuit through a cascade condenser, the secondary refrigerant circuit contains $CO_2$ gas with high temperature and high pressure. Thus, the defrosting can be achieved by permitting the $CO_2$ hot gas to circulate in the heat exchanger pipe in the cooling device. However, the cascade refrigerating device has the following problems. Specifically, the device is complicated and involves high cost because selector valves, branch pipes, and the like are provided. Furthermore, a control system is unstable due to high/low temperature heat balance.

The present invention is made in view of the above problems, and an object of the present invention is to enable reduction in initial and running costs required for defrosting a cooling device disposed in a cooling space such as a freezer, in a refrigeration apparatus using $CO_2$ refrigerant, as well as power saving.

Solution to Problem

A defrost system according to at least one embodiment of the present invention is:

(1) a defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy $CO_2$ refrigerant; and a refrigerant circuit connected to the heat exchanger pipe, for permitting the $CO_2$ refrigerant cooled and liquefied by the refrigerating device to circulate to the heat exchanger pipe, the defrost system including:

a defrost circuit which is branched from an inlet path and an outlet path of the heat exchanger pipe and forms a $CO_2$ circulation path together with the heat exchanger pipe;

an on-off valve which is disposed in each of the inlet path and the outlet path of the heat exchanger pipe and is configured to be closed at a time of defrosting so that the $CO_2$ circulation path becomes a closed circuit;

a pressure adjusting unit for adjusting a pressure of the $CO_2$ refrigerant circulating in the closed circuit at the time of defrosting; and a first heat exchanger unit for heating the $CO_2$ refrigerant circulating in the defrost circuit with brine, which is disposed below the cooling device and to which the defrost circuit and a first brine circuit in which the brine as a first heating medium circulates, are led, in which the $CO_2$ refrigerant is permitted to naturally circulate in the closed circuit at the time of defrosting by a thermosiphon effect.

In the configuration (1), the closed circuit is formed by closing the on-off valve at the time of defrosting. The pressure in the closed circuit is adjusted by the pressure adjusting unit, so that the temperature of the $CO_2$ refrigerant in the closed circuit is kept at condensing temperature higher than the freezing point (for example, 0° C.) of water vapor in the freezer inner air.

A part of the $CO_2$ refrigerant returns to the refrigerant circuit when the pressure of the $CO_2$ refrigerant in the closed circuit exceeds the set pressure for keeping the $CO_2$ refrigerant at the condensing temperature. Thus, the pressure in the closed circuit is maintained at the set pressure.

The liquid $CO_2$ refrigerant in the closed circuit falls in the defrost circuit down to the first heat exchanger unit with gravity, and is heated and vaporized with the brine in the first heat exchanger unit. The vaporized $CO_2$ refrigerant rises in the defrost circuit by a thermosiphon effect, and the $CO_2$ refrigerant gas that has risen heats and melts frost attached on an outer surface of the heat exchanger pipe disposed in the cooling device. The $CO_2$ refrigerant that has emitted heat to the frost and thus liquefied falls in the defrost circuit with gravity. The liquid CO2 refrigerant that has fallen to the first heat exchanger unit is heated and vaporized again in the first heat exchanger unit.

The "freezer" includes anything that forms a refrigerator and other cooling spaces. The drain receiver unit includes a drain pan, and further includes anything with a function to receive and store drainage.

The "inlet path" and the "outlet path" of the heat exchanger pipe are areas of the heat exchanger pipe disposed in the freezer. The areas extend from an area around a partition wall of the casing of the cooling device to the outer side of the casing.

The configuration (1) is described. In the convention defrosting method, the sensible heat of the brine is transmitted to the heat exchanger pipe (outer surface) through external heat transmission through the fins as disclosed in Patent Document 3. On the other hand, in the configuration (1), the frost attached to the outer surface of the heat exchanger pipe is removed with the condensation latent heat of the $CO_2$ refrigerant at the condensing temperature higher than the freezing point of the water vapor in the freezer inner air through a pipe wall from the inside of the heat exchanger pipe. Thus, more heat can be transmitted to the frost.

In the conventional defrosting method, the amount of heat input at an early stage of defrosting is wasted for vaporizing the liquid CO2 refrigerant in the cooling device, and thus the thermal efficiency is low. On the other hand, in the configuration (1), heat exchange between the closed circuit formed at the time of defrosting and other portions is blocked, whereby the thermal energy in the closed circuit is not emitted outside, and thus the power saving defrosting can be performed.

The $CO_2$ refrigerant is permitted to naturally circulate in the closed circuit formed of the refrigerant circuit and the defrost circuit by the thermosiphon effect. Thus, a power source such as a pump for circulating the $CO_2$ refrigerant is not required, and thus further power saving can be achieved.

When the temperature of the $CO_2$ refrigerant at the time of defrosting is kept at the temperature not lower than and closer to the freezing point of the water vapor in the freezer inner air, the defrosting requires a longer time, but the pressure of the $CO_2$ refrigerant can be reduced. Thus, the pipes and the valves forming the closed circuit may be designed for lower pressure, whereby further cost reduction can be achieved.

In some embodiments, in the configuration (1), (2) the first brine circuit includes a brine circuit led to the drain receiver unit.

In the configuration (2), the first brine circuit is led to the drain receiver unit. Thus, the drainage that has dropped to the drain receiver unit can be prevented from refreezing at the time of defrosting. Thus, no defrosting heater needs to be additionally provided to the drain receiver unit, whereby the cost reduction can be achieved.

In some embodiments, in the configuration (1), (3) the defrost circuit and the first brine circuit are led to the drain receiver unit, the first heat exchanger unit includes the defrost circuit led to the drain receiver unit and the first brine circuit led to the drain receiver unit, and the defrost system is configured to heat the drain receiver unit and the $CO_2$ refrigerant in the defrost circuit with the brine circulating in the first brine circuit.

In the configuration (3), the first heat exchanger unit can heat the drain receiver unit and the $CO_2$ refrigerant circulating in the defrost circuit at the same time.

Thus, no defrosting heater needs to be additionally provided to the drain receiver unit, whereby the cost reduction can be achieved.

In some embodiments, the configuration (1)

(4) further includes a second heat exchanger unit for heating the brine with a second heating medium, in which the first brine circuit is disposed between the first heat exchanger unit and the second heat exchanger unit.

Any heating medium can be used as the second heating medium. For example, such a heating medium includes refrigerant gas with high temperature and high pressure discharged from a compressor included in the refrigerating device, warm discharge water from a factory, a medium that has absorbed heat emitted from a boiler or potential heat of an oil cooler, and the like.

In the configuration (4), the extra exhaust heat from the factory can be used as the heat source for heating the brine. When the first heat exchanger unit is formed of a plate heat exchanger unit and the like, for example, the efficiency of the heat exchange between the brine and the $CO_2$ refrigerant can be improved.

In some embodiments, any one of the configurations (1) to (4)

(5) further includes a second brine circuit branched from the first brine circuit, and led into the cooling device, for heating the $CO_2$ refrigerant circulating in the heat exchanger pipe with the brine.

In the configuration (5), the frost attached to the heat exchanger pipe is heated from the inside and the outside of the heat exchanger pipe at the time of defrosting, and thus higher heating effect can be achieved, and the defrosting time can be shortened. Furthermore, the frost can be easily removed from fins attached on an external surface of the heat exchanger pipe.

Instead of shortening the defrosting operation, the condensing temperature of the $CO_2$ refrigerant circulating in the closed circuit can be set to be lower. Thus, the thermal load and the water vapor diffusion can be prevented as much as possible.

In some embodiments, any one of the configurations (1) to (5)

(6) further includes a first temperature sensor and a second temperature sensor which are respectively disposed at an inlet and an outlet of the first brine circuit, for detecting a temperature of the brine flowing through the inlet and the outlet.

In the configuration (6), the frost attached to the heat exchanger pipe is heated with sensible heat with the brine, whereby the timing at which the defrosting operation is completed can be determined based on a difference between the detection values of the first temperature sensor and the second temperature sensor. More specifically, a small difference between the detection values of the two temperature sensors indicates that the defrosting is almost completed. Thus, the timing at which the defrosting is completed can be accurately determined.

Thus, the excessive heating and the water vapor diffusion in the freezer can be prevented, whereby further power saving can be achieved, and the quality of the food products cooled in the freezer can be improved with a more stable freezer inner temperature.

In some embodiments, in the configuration (1), (7) the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver for storing the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit.

In the configuration (7), the refrigerating device using natural refrigerants of $NH_3$ and $CO_2$ is obtained, whereby an attempt to prevent the ozone layer depletion, global warming, and the like is facilitated. $NH_3$, with high cooling performance and toxicity, is used as a primary refrigerant and $CO_2$, with no toxicity or smell, is used as a secondary refrigerant, and thus the refrigerating device can be used for room air conditioning and for refrigerating food products.

In some embodiments, in the configuration (1), (8) the refrigerating device is a $NH_3/CO_2$ cascade refrigerating device including:

a primary refrigerant circuit in which $NH_3$ refrigerant circulates and a refrigerating cycle component is disposed; and a secondary refrigerant circuit in which the $CO_2$ refrigerant circulates and a refrigerating cycle component is disposed, the secondary refrigerant circuit led to the cooling device, the secondary refrigerant circuit being connected to the primary refrigerant circuit through a cascade condenser.

In the configuration (8), the natural refrigerants are used and thus an attempt to prevent the ozone layer depletion, global warming, and the like is facilitated. Furthermore, the cascade refrigerating device is obtained, and thus the COP of the refrigerating device can be improved.

In some embodiments, the configuration (7) or (8)

(9) further includes a cooling water circuit led to a condenser as a part of the refrigerating cycle component disposed in the primary refrigerant circuit, in which the second heat exchanger unit includes a heat exchanger unit to which the cooling water circuit and the first brine circuit is led, for heating the brine circulating in the first brine circuit with cooling water circulating in the cooling water circuit and having been heated in the condenser.

In the configuration (9), the brine can be heated with the cooling water heated in the condenser. Thus, no heating source is required outside the refrigeration apparatus.

The cooling water exchanges heat with the brine and thus can have the temperature reduced at the time of defrosting. Thus, the COP (coefficient of performance) of the refrigerating device can be improved by lowering the condensing temperature of the $NH_3$ refrigerant at the time of refrigerating operation.

In an exemplary embodiment where the cooling water circuit is disposed between the condenser and the cooling tower, the heat exchanger unit can be disposed in the cooling tower, whereby an installation space for a device used for the defrosting can be downsized.

In some embodiments, the configuration (7) or (8)

(10) further includes a cooling water circuit led to a condenser as a part of the refrigerating cycle component disposed in the primary refrigerant circuit, in which the second heat exchanger unit includes:

a cooling tower for cooling cooling water circulating in the cooling water circuit with spray water; and a heating tower for receiving the spray water and heating the brine circulating in the first brine circuit with the spray water.

In the configuration (10), by integrating the heating tower and the cooling tower, the installation space for the second heat exchanger unit can be downsized.

In some embodiments, in the configuration (1),

(11) the pressure adjusting unit includes a pressure adjustment valve disposed in the outlet path of the heat exchanger pipe.

In the configuration (1), the pressure adjusting unit can be simplified and can be provided with a low cost. A part of the $CO_2$ refrigerant returns to the refrigerant circuit through the pressure adjustment valve when the pressure of the $CO_2$ refrigerant in the closed circuit exceeds a set pressure. Thus, the pressure in the closed circuit is maintained at the set pressure.

In some embodiments, in the configuration (1),

(12) the pressure adjusting unit is for adjusting a temperature of the brine flowing into the first heat exchanger unit to adjust the pressure of the $CO_2$ refrigerant circulating in the closed circuit.

In the configuration (12), the $CO_2$ refrigerant in the closed circuit is heated with the brine to increase the pressure of the $CO_2$ refrigerant in the closed circuit.

In the configuration (12), the pressure adjusting unit needs not to be provided for each cooling device, and only a single pressure adjusting unit needs to be provided. Thus, the cost reduction can be achieved, and the pressure in the closed circuit can be easily adjusted with the pressure in the closed circuit adjusted from the outside of the freezer.

In some embodiments, in any one of the configurations (1) to (3),

(13) the drain receiver unit further includes an auxiliary heating electric heater.

In the configuration (13), the auxiliary heating electric heater can prevent the drainage stored in the drain receiver unit from refreezing. Even when the amount of heat of the brine circulating in the first brine circuit led to the drain receiver unit falls short, the auxiliary heating electric heater can add the vaporization heat of the $CO_2$ refrigerant circulating in the defrost circuit when the first heat exchanger unit is formed on the drain receiver unit.

A cooling unit according to at least one embodiment of the present invention is:

(14) a cooling unit including:

a cooling device which includes: a casing; a heat exchanger pipe led into the casing; and a drain pan disposed below the heat exchanger pipe;

a defrost circuit which is branched from an inlet path and an outlet path of the heat exchanger pipe and forms a $CO_2$ circulation path together with the heat exchanger pipe;

an on-off valve which is disposed in each of the inlet path and the outlet path of the heat exchanger pipe and which is configured to be closed at a time of defrosting so that the $CO_2$ circulation path becomes a closed circuit; and a heat exchanger unit which includes the defrost circuit led to the drain pan and a first brine circuit led to the drain pan and is configured to heat the drain receiver unit with the brine circulating in the first brine circuit.

In the configuration (14), the cooling device with a defrosting device can be easily attached to a freezer. When the components of the cooling unit are integrally assembled, the cooling unit can be more easily attached.

In some embodiments, the configuration (14)

(15) further includes a second brine circuit branched from the first brine circuit and led into the cooling device, for heating the $CO_2$ refrigerant circulating in the heat exchanger pipe with the brine.

In the configuration (15), the cooling device with the defrosting device which heats the heat exchanger pipe in the cooling device from both inner and outer sides at the time of defrosting and thus can improve the heating effect can be easily attached.

When an auxiliary heating electric heater is further provided to the drain pan of the cooling unit, the cooling device with the defrosting device which can auxiliary heat the $CO_2$ refrigerant circulating in the defrost circuit led to the drain pan, as well as the drain pan, can be easily attached.

Advantageous Effects

According to at least one embodiment of the present invention, the heat exchanger pipe disposed in the cooling device is defrosted from the inside with the $CO_2$ refrigerant, whereby reduction in initial and running costs required for defrosting the refrigeration apparatus and power saving can be achieved.

DETAILED DESCRIPTION

Some embodiments of the present invention will now be described in detail with reference to the accompanying drawings. It is intended, however, that dimensions, materials, shapes, relative positions, and the like of components described in the embodiments shall be interpreted as illustrative only and not limitative of the scope of the present invention.

For example, expressions indicating a relative or absolute arrangement such as "in a certain direction", "along a certain direction", "parallel to", "orthogonal to", "center of", "concentric to", and "coaxially" do not only strictly indicate such arrangements but also indicate a state including a tolerance or a relative displacement within an angle and a distance achieving the same function.

For example, expressions such as "the same", "equal to", and "equivalent to" indicating a state where the objects are the same, do not only strictly indicate the same state, but also indicate a state including a tolerance or a difference achieving the same function.

For example, expressions indicating shapes such as rectangular and cylindrical do not only indicate the shapes such as rectangular and cylindrical in a geometrically strict sense, but also indicate shapes including recesses/protrusions, chamfered portions, and the like, as long as the same effect can be obtained.

Expressions such as "comprising", "including", "includes", "provided with", or "having" a certain component are not exclusive expressions that exclude other components.

FIG. 1 to FIG. 11 show refrigeration apparatuses 10A to 10F including defrost systems according to some embodiments of the present invention.

The refrigeration apparatuses 10A to 10F each include: cooling devices 33*a* and 33*b* respectively disposed in freezers 30*a* and 30*b*; a refrigerating device 11A or 11D for cooling and liquefying $CO_2$ refrigerant; and a refrigerant circuit (corresponding to a secondary refrigerant circuit 14) which permits the $CO_2$ refrigerant cooled and liquefied by the refrigerating device to circulate to the cooling devices 33*a* and 33*b*. The cooling devices 33*a* and 33*b* respectively include: casings 34*a* and 34*b*; heat exchanger pipes 42*a* and 42*b* disposed in the casings; and drain pans 50*a* and 50*b* disposed below the heat exchanger pipes 42*a* and 42*b*.

Figure 9:
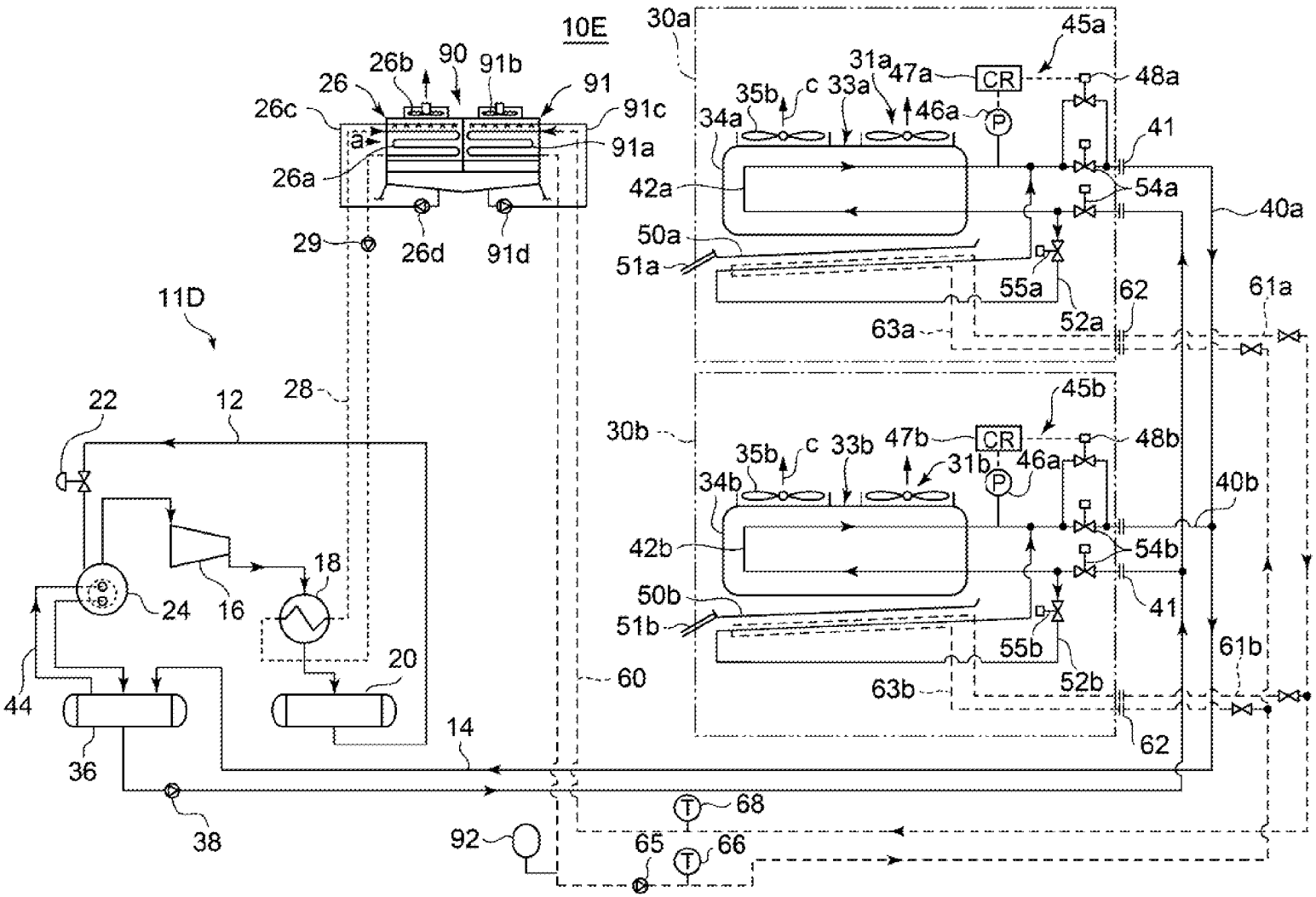
FIG. 9 is a general configuration diagram of a refrigeration apparatus according to one embodiment.

The refrigerating device 11A shown in FIG. 1 to FIG. 3, FIG. 6, and FIG. 10 and the refrigerating device 11D shown in FIG. 9 include: a primary refrigerant circuit 12 in which $NH_3$ refrigerant circulates and a refrigerating cycle component is disposed; and a secondary refrigerant circuit 14 in which the $CO_2$ refrigerant circulates, the secondary refrigerant circuit extending to the cooling devices 33*a* and 33. The secondary refrigerant circuit 14 is connected to the primary refrigerant circuit 12 through a cascade condenser 24.

The refrigerating cycle component disposed in the primary refrigerant circuit 12 includes a compressor 16, a condenser 18, a liquid $NH_3$ receiver 20, an expansion valve 22, and the cascade condenser 24.

The secondary refrigerant circuit 14 includes a liquid $CO_2$ receiver 36 which stores the liquid $CO_2$ refrigerant liquefied in the cascade condenser 24 and a liquid $CO_2$ pump 38 for permitting the liquid $CO_2$ refrigerant stored in the liquid $CO_2$ receiver 36 to circulate to the heat exchanger pipes 42*a* and 42*b*.

A $CO_2$ circulation path 44 is disposed between the cascade condenser 24 and the liquid $CO_2$ receiver 36. $CO_2$ refrigerant gas introduced from the liquid $CO_2$ receiver 36 to the cascade condenser 24 through the $CO_2$ circulation path 44 is cooled and liquefied with the $NH_3$ refrigerant in the cascade condenser 24, and then returns to the liquid $CO_2$ receiver 36.

The refrigerating devices 11A and 11D use natural refrigerants of $NH_3$ and $CO_2$ and thus facilitate an attempt to prevent the ozone layer depletion, global warming, and the like. Furthermore, the refrigerating devices 11A and 11D use $NH_3$, with high cooling performance and toxicity, as a primary refrigerant and use $CO_2$, with no toxicity or smell, as a secondary refrigerant, and thus can be used for room air conditioning and for refrigerating food products.

In the refrigeration apparatuses 10A to 10F, the secondary refrigerant circuit 14 is branched to $CO_2$ branch circuits 40*a* and 40*b* outside the freezers 30*a* and 30*b*. The $CO_2$ branch circuits 40*a* and 40*b* are connected to an inlet tube 42*c* and an outlet tube 42*d* of the heat exchanger pipes 42*a* and 42*b* led to the outside of the casings 34*a* and 34*b*, respectively.

Figure 4:
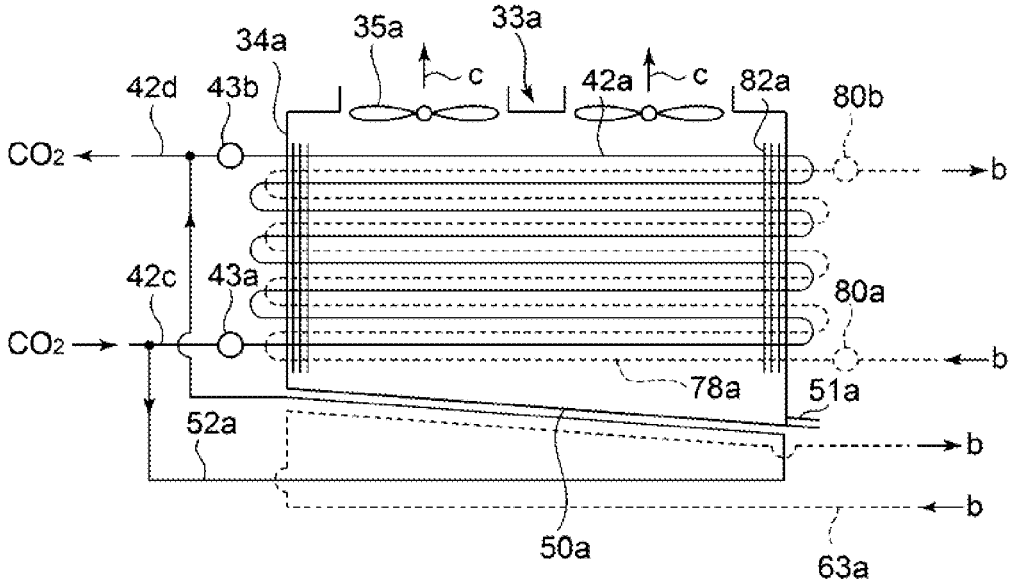
FIG. 4 is a sectional view of a cooling device in the refrigeration apparatus shown in FIG. 3.
Figure 11:
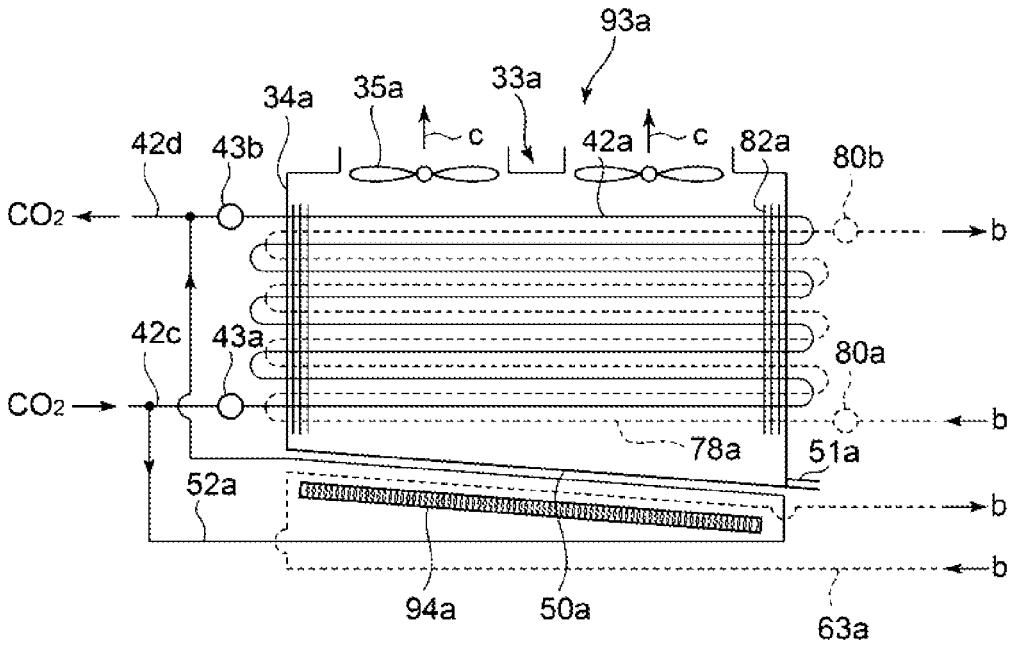
FIG. 11 is a sectional view of a cooling device according to one embodiment.

The "inlet tube 42*c*" and the "outlet tube 42*d*" described above are areas of the heat exchanger pipes 42*a* and 42*b* outside the casings 34*a* and 34*b* and in the freezers 30*a* and 30*b* (refer to FIG. 4 and FIG. 11).

In the freezers 30*a* and 30*b*, solenoid on-off valves 54*a* and 54*b* are disposed in the inlet tube 42*c* and the outlet tube 42*d*. Defrost circuits 52*a* and 52*b* are connected to the inlet tube 42*c* and the outlet tube 42*d* between the solenoid on-off valves 54*a* and 54*b* and the cooling devices 33*a* and 33*b*.

The defrost circuits 52*a* and 52*b* form a $CO_2$ circulation path together with the heat exchanger pipes 42*a* and 42*b*. The $CO_2$ circulation path becomes a closed circuit when the solenoid on-off valves 54*a* and 54*b* close at the time of defrosting.

Solenoid on-off valves 55*a* and 55*b* are disposed in the defrost circuits 52*a* and 52*b*. At the time of a refrigerating operation, the solenoid on-off valves 54*a* and 54*b* are opened and the solenoid on-off valves 55*a* and 55*b* are closed. At the time of defrosting, the solenoid on-off valves 54*a* and 54*b* are closed and the solenoid on-off valves 55*a* and 55*b* are opened.

In the refrigeration apparatuses 10A to 10E, pressure adjusting units 45*a* and 45*b* are disposed in the outlet tube 42*d* of the heat exchanger pipes 42*a* and 42*b*. The pressure adjusting units 45*a* and 45*b* respectively include: pressure adjustment valves 48*a* and 48*b* disposed in parallel with the solenoid on-off valves 54*a* and 54*b* disposed in the outlet tube 42*d*; pressure sensors 46*a* and 46*b* disposed in the outlet tube 42*d* on the upstream side of the pressure adjustment valves 48*a* and 48*b* and detecting pressure of the $CO_2$ refrigerant; and control devices 47*a* and 47*b* to which detected values of the pressure sensors 46*a* and 46*b* are input. The control devices 47*a* and 47*b* control valve apertures of the pressure adjustment valves 48*a* and 48*b* at the time of defrosting based on the detected values from the pressure sensors 46*a* and 46*b*. Thus, the pressure of the $CO_2$ refrigerant is controlled in such a manner that condensing temperature of the $CO_2$ refrigerant circulating in the closed circuit becomes higher than a freezing point (for example, 0° C.) of water vapor in the air in the freezer.

Figure 10:
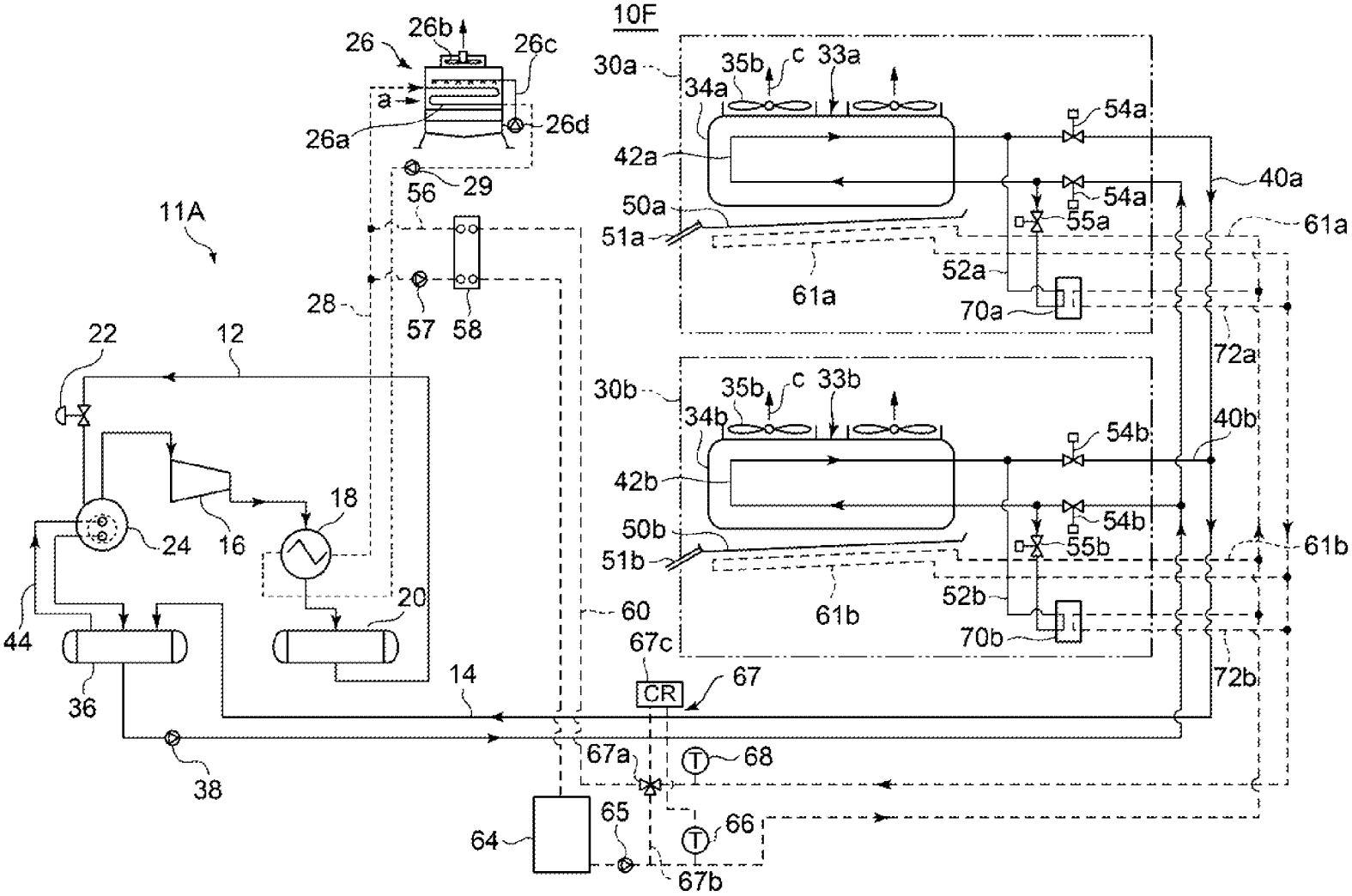
FIG. 10 is a general configuration diagram of a refrigeration apparatus according to one embodiment.

In the refrigeration apparatus 10F shown in FIG. 10, a pressure adjusting unit 67 is disposed instead of the pressure adjusting units 45*a* and 45*b*. The pressure adjusting unit 67 includes: a three way valve 67*a* dispose on the downstream side of a temperature sensor 68 in a brine circuit (send path) 60; a bypass path 67*b* connected to the three way valve 67*a* and the brine circuit (return path) 60 on the upstream side of a temperature sensor 66; and a control device 67*c* to which a temperature of brine detected by the temperature sensor 66 is input, the control device 67*c* controlling the three way valve 67*a* in such a manner that the input value becomes equal to a set temperature. The control device 67*c* controls the three way valve 67*a* in such a manner that a temperature of the brine supplied to brine branch paths 61*a* and 61*b* is adjusted to be at a set value (for example, 10 to 15° C.).

The brine circuit 60 (the first brine circuit shown with a dashed line) in which the brine as a first heating medium circulates is disposed. The brine circuit 60 is branched to the brine branch circuits 61*a* and 61*b* (shown with a dashed line) outside the freezers 30*a* and 30*b*.

Figure 1:
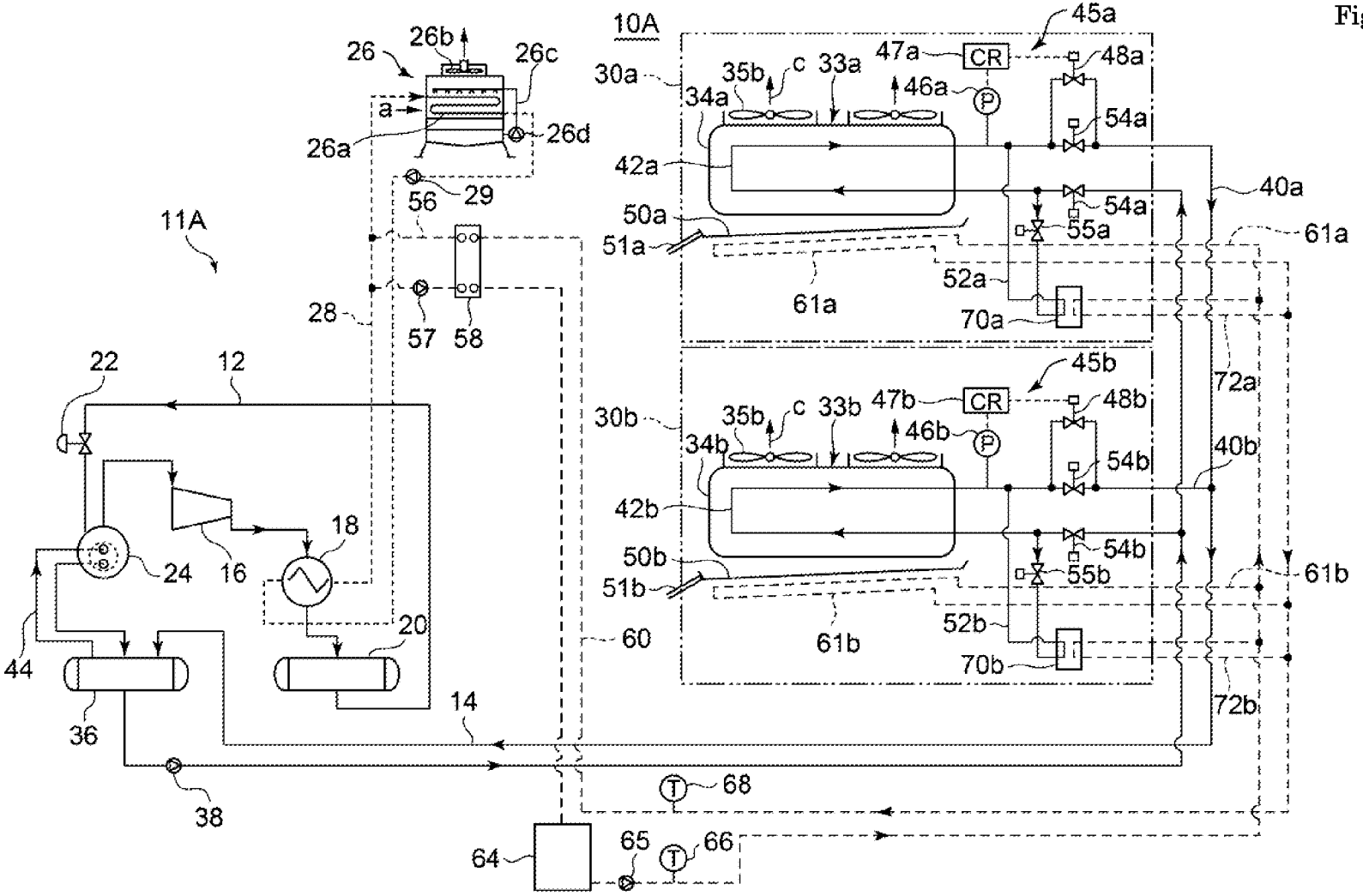
FIG. 1 is a general configuration diagram of a refrigeration apparatus according to one embodiment.
Figure 6:
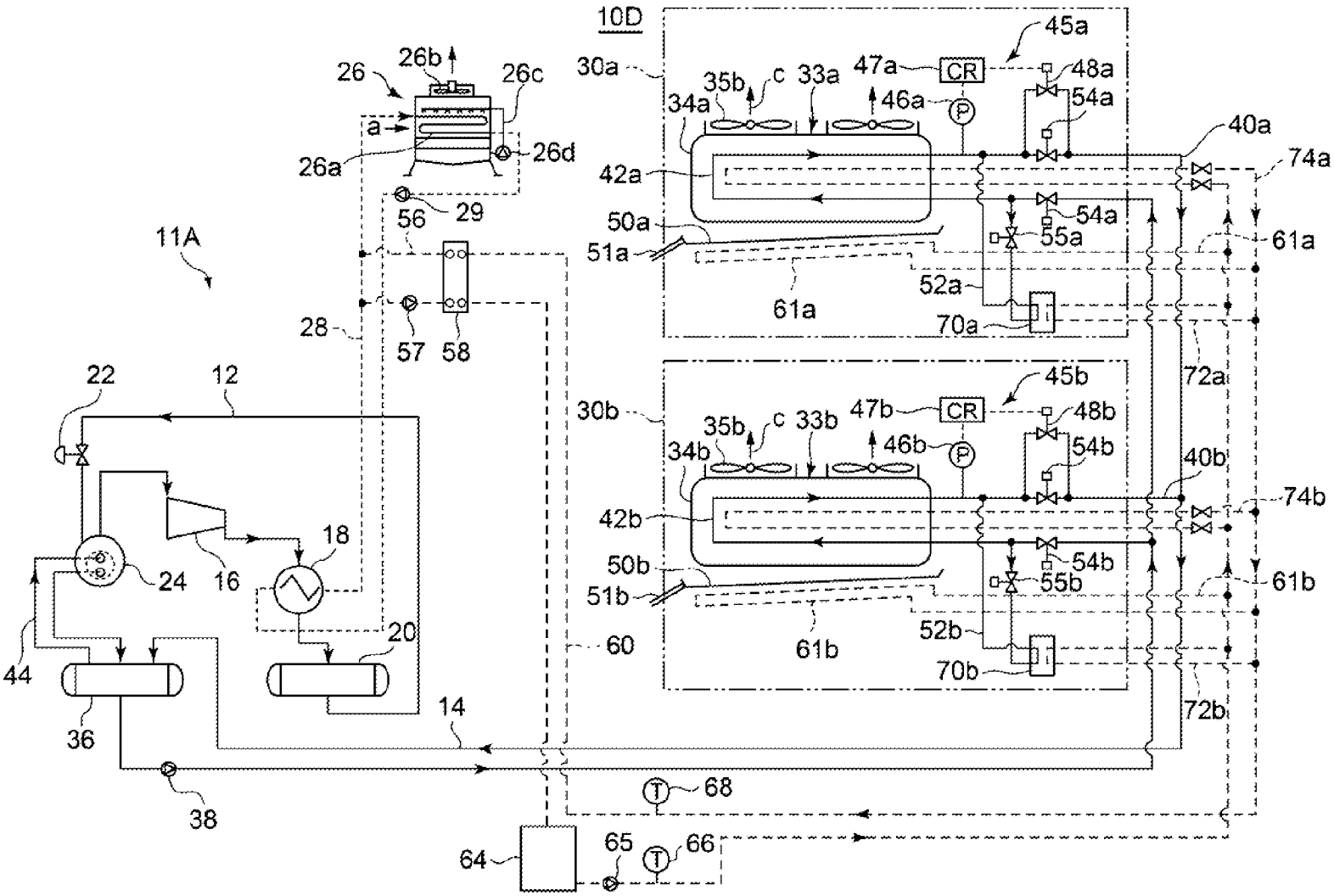
FIG. 6 is a general configuration diagram of a refrigeration apparatus according to one embodiment.

In the embodiments shown in FIG. 1, FIG. 6, and the like, the brine branch circuits 61*a* and 61*b* are led into the freezers 30*a* and 30*b* and are disposed on back surfaces of the drain pans 50*a* and 50*b*.

Figure 2:
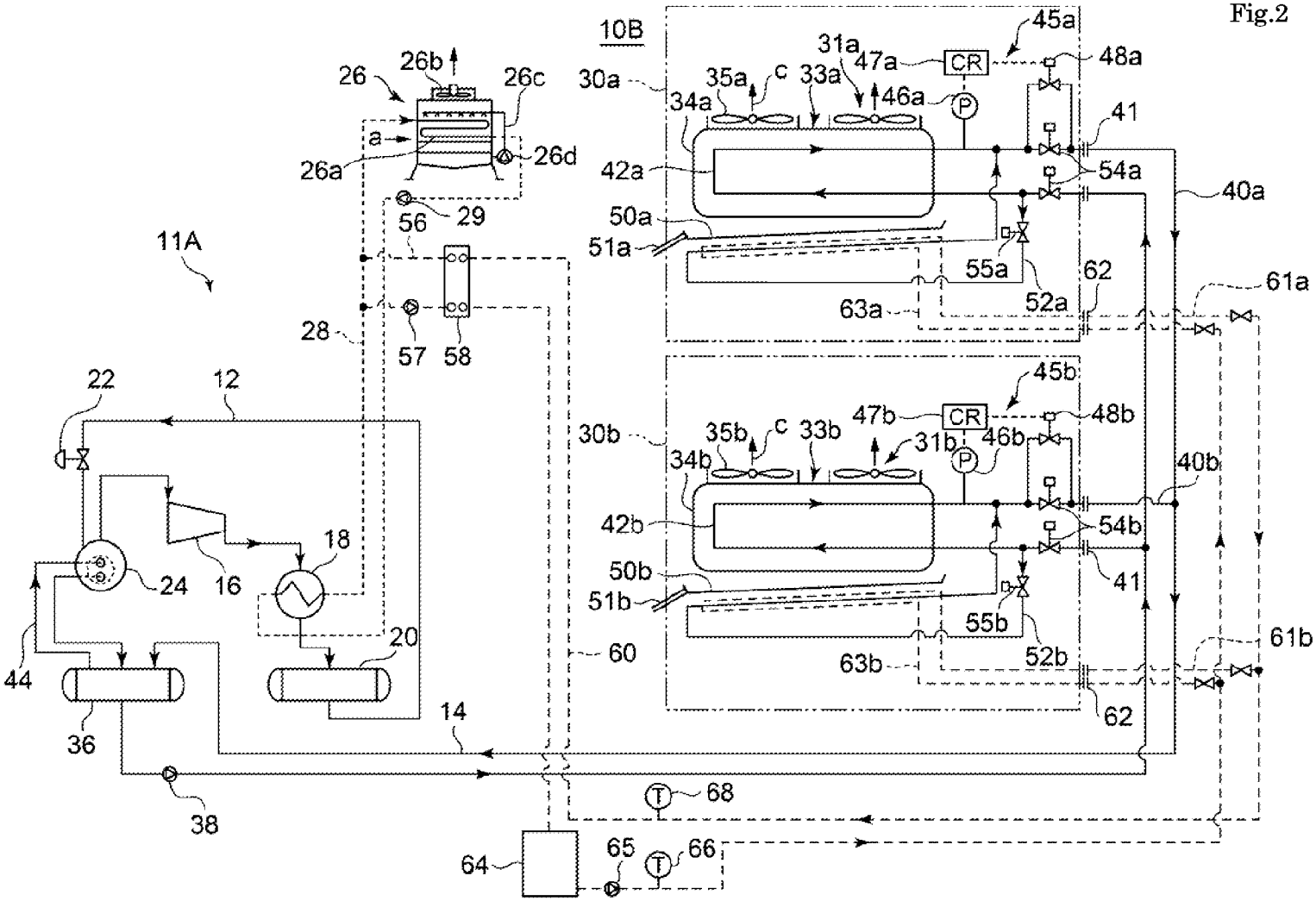
FIG. 2 is a general configuration diagram of a refrigeration apparatus according to one embodiment.
Figure 3:
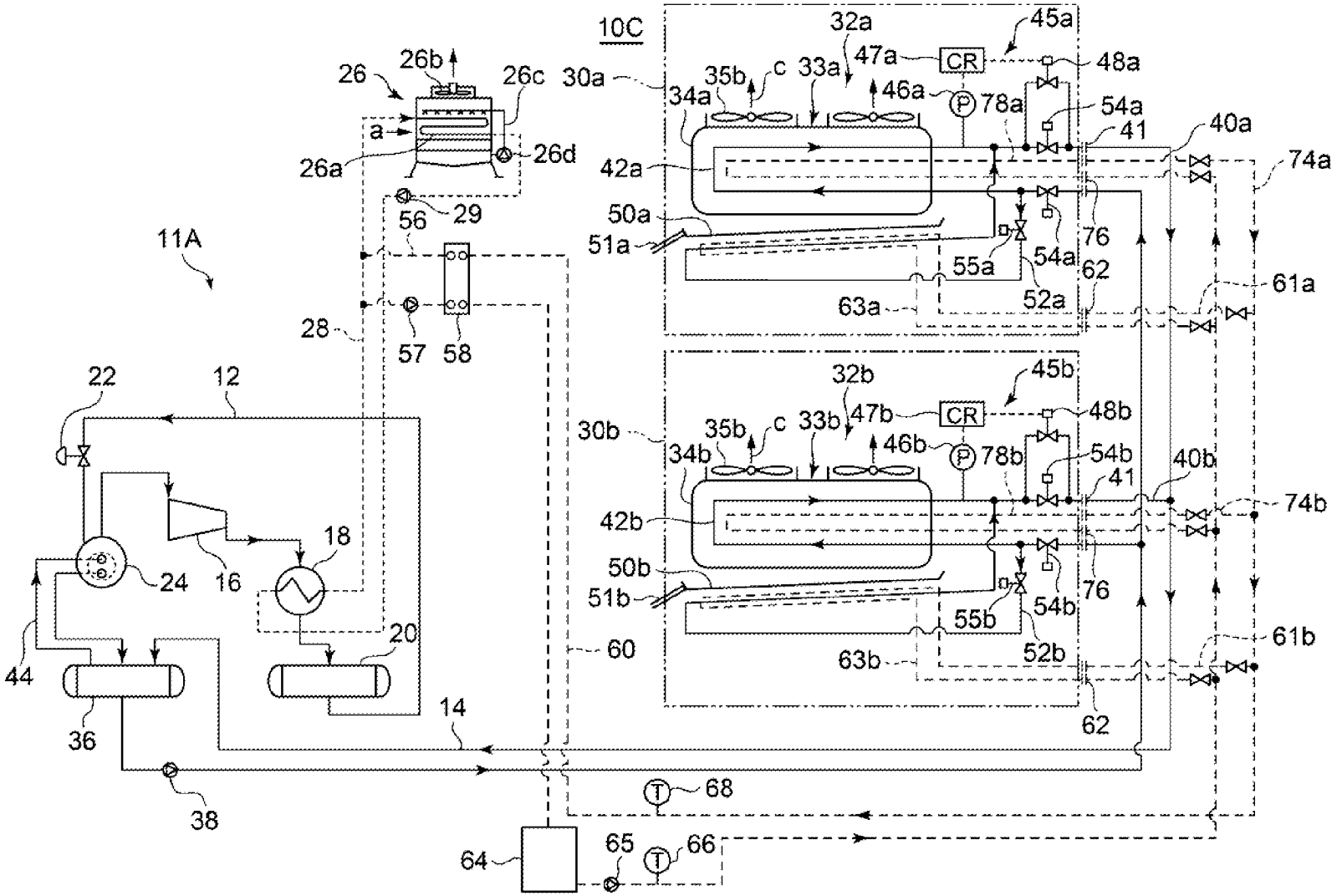
FIG. 3 is a general configuration diagram of a refrigeration apparatus according to one embodiment.

In the embodiments shown in FIG. 2, FIG. 3, and FIG. 9, the brine branch circuits 61*a* and 61*b* are connected to brine branch circuits 63*a* and 63*b* (shown with a dashed line) through a contact part 62 outside the freezers 30*a* and 30*b*.

The brine branch circuits 63*a* and 63*b* are led to the back surfaces of the drain pans 50*a* and 50*b*.

In this configuration, sensible heat of the brine circulating in the brine branch circuits 61*a* and 61*b* or 63*a* and 63*b* can prevent drainage that has dropped onto the brine branch circuits 61*a*, 61*b* or 63*a*, from refreezing at the time of defrosting.

In the embodiments shown in FIG. 1 and FIG. 6, heat exchangers 70*a* and 70*b* are disposed below the heat exchanger pipes 42*a* and 42*b* in the freezers 30*a* and 30*b*. The defrost circuits 52*a* and 52*b* are led to the heat exchangers 70*a* and 70*b*.

The brine circuit 60 is branched to brine branch circuits 72*a* and 72*b* outside the freezers 30*a* and 30*b*. The brine branch circuits 72*a* and 72*b* are respectively led to the heat exchangers 70*a* and 70*b*.

In the embodiments shown in FIG. 2, FIG. 3, FIG. 9, and the like, the brine branch circuits 63*a*, 63*b* and the defrost circuits 52*a* and 52*b* are led to the back surfaces of the drain pans 50*a* and 50*b* instead of providing the heat exchangers 70*a* and 70*b*. A heat exchanger unit (first heat exchanger unit) is formed in which the brine circulating in the brine branch circuits 63*a* and 63*b* heats the $CO_2$ refrigerant circulating in the defrost circuits 52*a* and 52*b*.

The brine circulating in the brine branch circuits 63*a* and 63*b* can heat the drain pans 50*a* and 50*b*.

In the embodiments described above, the brine circulating in the brine circuit 60 can be heated with another heating medium.

In some embodiments shown in FIG. 1 to FIG. 3, FIG. 6, and the like, a cooling water circuit 28 is led to the condenser 18. A cooling water branch circuit 56 including a cooling water pump 57 is branched from the cooling water circuit 28, and is connected to a heat exchanger unit 58 (second heat exchanger unit). The brine circuit 60 is also connected to the heat exchanger unit 58.

Cooling water circulating in the cooling water circuit 28 is heated with the $NH_3$ refrigerant in the condenser 18. The heated cooling water (second heating medium) heats the brine circulating in the brine circuit 60 as the heating medium at the time of defrosting, in the heat exchanger unit 58.

For example, when a temperature of the cooling water introduced to the cooling water branch circuit 56 is 20 to 30° C., the brine can be heated up to 15 to 20° C. with the cooling water.

An aqueous solution such as ethylene glycol or propylene glycol can be used as the brine for example.

In other embodiments, for example, any heating medium other than the cooling water can be used as the second heating medium. Such a heating medium includes $NH_3$ refrigerant gas with high temperature and high pressure discharged from the compressor 16, warm discharge water from a factory, a medium that has absorbed heat emitted from a boiler or potential heat of an oil cooler, and the like.

In the exemplary configurations in some embodiments shown in FIG. 1 to FIG. 3, FIG. 6, and the like, the cooling water circuit 28 is disposed between the condenser 18 and a closed-type cooling tower 26. A cooling water pump 29 makes the cooling water circulate in the cooling water circuit 28. The cooling water that has absorbed exhaust heat from the $NH_3$ refrigerant in the condenser 18 comes into contact with the outer air and spray water in the closed-type cooling tower 26 and is cooled with vaporization latent heat of the spray water.

The closed-type cooling tower 26 includes: a cooling coil 26*a* connected to the cooling water circuit 28; a fan 26*b* that blows outer air a into the cooling coil 26*a*; and a spray pipe 26*c* and a pump 26*d* for spraying the cooling water onto the cooling coil 26*a*. The cooling water sprayed from the spray pipe 26*c* partially vaporizes. The cooling water flowing in the cooling coil 26*c* is cooled with the vaporization latent heat thus produced.

In the embodiment shown in FIG. 9, a closed-type cooling and heating unit 90 integrating the closed-type cooling tower 26 and a closed-type heating tower 91 is provided. A configuration of the closed-type cooling tower 26 in the present embodiment is basically the same as that of the closed-type cooling tower 26 in the embodiments described above.

The brine circuit 60 is connected to the closed-type heating tower 91. The closed-type heating tower 91 includes: a heating coil 91*a* connected to the brine circuit 60; and a spray pipe 91*c* and a pump 91*d* for spraying the cooling water onto the cooling coil 91*a*. An inside of the closed-type cooling tower 26 communicates with an inside of the closed-type heating tower 91 through a lower portion of a common housing.

The cooling water that has absorbed the exhaust heat from the $NH_3$ refrigerant circulating in the primary refrigerant circuit 12 is sprayed onto the cooling coil 91*a* from the spray pipe 91*c*, and is used as a heating medium which heats the brine circulating in the brine circuit 60.

In the embodiments shown in FIG. 3 and FIG. 6, brine branch circuits 74*a* and 74*b* are branched from the brine circuit 60 outside the freezers 30*a* and 30*b*.

In the embodiment shown in FIG. 3, the brine branch circuits 74*a* and 74*b* are connected to brine branch circuits 78*a* and 78*b* (the second brine circuit shown with a dashed line) through a contact part 76 outside the freezers 30*a* and 30*b*. The brine branch circuits 78*a* and 78*b* are led into the cooling devices 33*a* and 33*b*, disposed adjacent to the heat exchanger pipes 42*a* and 42*b*, and form a heat exchanger unit which heats the $CO_2$ refrigerant circulating in the heat exchanger pipes 42*a* and 42*b* with the brine circulating in the brine branch circuits 78*a* and 78*b*.

In the embodiment shown in FIG. 6, the brine branch circuits 74*a* and 74*b* are led into the cooling devices 33*a* and 33*b*, and form a heat exchanger unit having a configuration similar to that of the heat exchanger unit described above.

In some embodiments shown in FIG. 1 to FIG. 3, FIG. 6, and the like, a receiver (open brine tank) 64 that stores the brine, a brine pump 65 that makes the brine circulate, and the temperature sensor 66 that detects a temperature of the $CO_2$ refrigerant are disposed in the send path of the brine circuit 60. The temperature sensor 68 that detects the temperature of the temperature sensor 68 is disposed in the return path of the brine circuit 60.

In the embodiment shown in FIG. 9, an expansion tank 92 for offsetting pressure change and adjusting a flowrate of the brine is disposed instead of the receiver 64.

Figure 7:
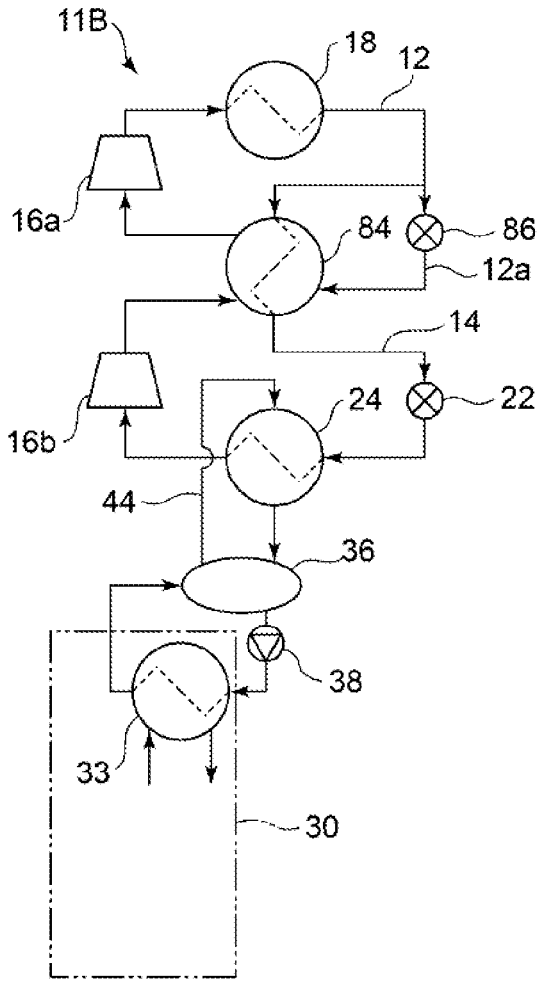
FIG. 7 is a system diagram of a refrigerating device according to one embodiment.

FIG. 7 shows a refrigerating device 11B that can be applied to the present invention and has a configuration different from those of the refrigerating devices 11A and 11D.

In the refrigerating device 11B, a lower stage compressor 16*b* and a higher stage compressor 16*a* are disposed in the primary refrigerant circuit 12 in which the $NH_3$ refrigerant circulates. An intermediate cooling device 84 is disposed in the primary refrigerant circuit 12 and between the lower stage compressor 16*b* and the higher stage compressor 16*a*. A branch path 12*a* is branched from the primary refrigerant circuit 12 at an outlet of the condenser 18, and an intermediate expansion valve 86 is disposed in the branch path 12*a*.

The $NH_3$ refrigerant flowing in the branch path 12*a* is expanded and cooled in the intermediate expansion valve 86, and is then introduced into the intermediate cooling device 84. In the intermediate cooling device 84, the $NH_3$ refrigerant discharged from the lower stage compressor 16*b* is cooled with the $NH_3$ refrigerant introduced from the branch path 12*a*.

The intermediate cooling device 84 can improve the COP of the refrigerating device 11B.

The liquid $CO_2$ refrigerant, cooled and liquefied by exchanging heat with the $NH_3$ refrigerant in the cascade condenser 24, is stored in the liquid $CO_2$ receiver 36. Then, the liquid $CO_2$ pump 38 makes the liquid $CO_2$ refrigerant circulate in the cooling device 33 disposed in the freezer 30, from the liquid $CO_2$ receiver 36.

Figure 8:
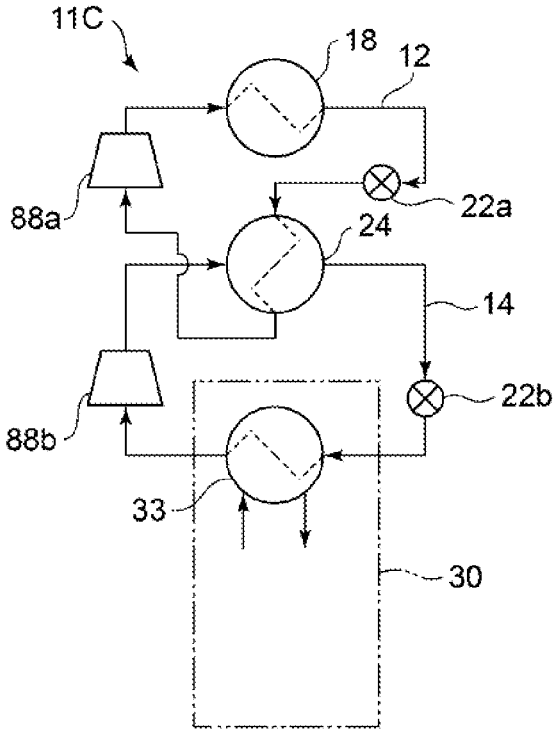
FIG. 8 is a system diagram of a refrigerating device according to one embodiment.

FIG. 8 shows a refrigerating device 11C that can be applied to the present invention and has still another configuration.

The refrigerating device 11C forms a cascade refrigerating cycle. A higher temperature compressor 88*a* and an expansion valve 22*a* are disposed in the primary refrigerant circuit 12. A lower temperature compressor 88*b* and an expansion valve 22*b* are disposed in the secondary refrigerant circuit 14 connected to the primary refrigerant circuit 12 through the cascade condenser 24.

The refrigerating device 11C is a cascade refrigerating device in which a mechanical compression refrigerating cycle is formed in each of the primary refrigerant circuit 12 and the secondary refrigerant circuit 14, whereby the COP of the refrigerating device can be improved.

In the embodiments shown in FIG. 2, FIG. 3, and FIG. 9, the $CO_2$ branch circuits 40*a* and 40*b* are respectively connected to the inlet tube 42*c* and the outlet tube 42*d* of the heat exchanger pipes 42*a* and 42*b* through a contact part 41, outside the freezers 30*a* and 30*b*.

The cooling device 33*a* shown in FIG. 4 is used for the refrigeration apparatus 10C shown in FIG. 3. The heat exchanger pipe 42*a* and the brine branch circuit 78*a*, led into the freezer 30*a*, are formed to have winding shapes in an upper and lower direction and a horizontal direction in the cooling device 33*a*.

The defrost circuit 52*a* and the brine branch circuit 63*a* disposed on the back surface of the drain pan 50*a* are formed to have winding shapes in the upper and lower direction and the horizontal direction. The cooling device 33*b* in FIG. 3 has a configuration that is similar to that of the cooling device 33*a* in FIG. 3.

In an exemplary configuration of the cooling device 33*a* shown in FIG. 11, an auxiliary heating electric heater 94*a* is disposed on the back surface of the drain pan 50*a*. Thus, when the amount of sensible heat of the brine circulating in the brine branch circuit 63*a* disposed on the back surface of the drain pan 50*a* falls short, the shortage amount can be covered.

In exemplary configurations of the cooling device 33*a* shown in FIG. 4 and FIG. 11, air openings are formed on upper and side surfaces (not shown) of the casing 34*a*. The freezer inner air c flows in through the side surface and flows out through the upper surface.

Figure 5:
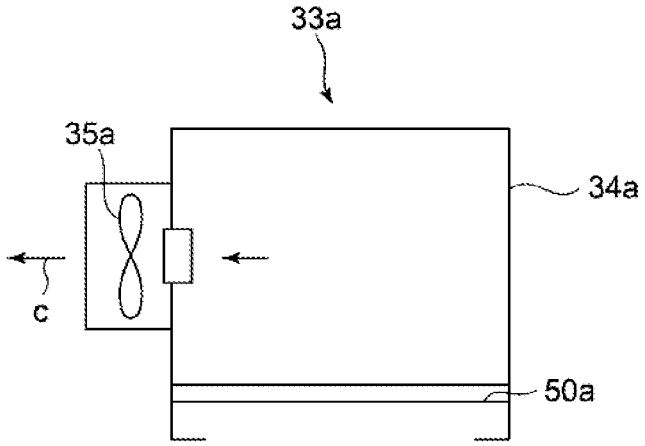
FIG. 5 is a sectional view of the cooling device according to one embodiment.

In an exemplary configuration of the cooling device 33*a* shown in FIG. 5, air openings are formed on both side surfaces, whereby the freezer inner air c flows in and out of the casing 34*a* through both side surfaces.

In the embodiments shown in FIG. 2 and FIG. 9, cooling units 31*a* and 31*b* are formed.

The cooling units 31*a* and 31*b* respectively include: the casings 34*a* and 34*b* forming the cooling devices 33*a* and 33*b*; the heat exchanger pipes 42*a* and 42*b* led into the casings; the inlet tube 42*c*; the outlet tube 42*d*; and the drain pans 50*a* and 50*b* disposed below the heat exchanger pipes 42*a* and 42*b*.

The heat exchanger pipes 42*a* and 42*b* are connected to the $CO_2$ branch circuits 40*a* and 40*b* disposed outside the freezers 30*a* and 30*b* through the contact part 41, to be attached to the freezers 30*a* and 30*b*.

The cooling units 31*a* and 31*b* respectively include: defrost circuits 52*a* and 52*b* branched from the inlet tube 42*c* and the outlet tube 42*d* outside the casings 34*a* and 34*b*; and the solenoid on-off valves 54*a* and 54*b* disposed in the inlet tube 42*c* and the outlet tube 42*d*. The solenoid on-off valves 54*a* and 54*b* can make the heat exchanger pipes 42*a* and 42*b*, which are more on the cooling device side than the defrost circuits 52*a* and 52*b* and branch portions of the defrost circuits, the closed circuit at the time of defrosting.

The cooling units 31*a* and 31 respectively include the pressure adjustment valves 48*a* and 48*b* disposed in the outlet tube 42*d* outside the casings 34*a* and 34*b* for adjusting pressure in the closed circuit.

The cooling units 31*a* and 31*b* respectively include the brine branch circuits 63*a* and 63*b* and the defrost circuits 52*a* and 52*b* that are led to the drain pans 50*a* and 50*b*, and form a heat exchanger unit which heats the $CO_2$ refrigerant circulating in the defrost circuits 52*a* and 52*b* with the brine circulating in the brine branch circuits 63*a* and 63*b*.

The brine branch circuits 63*a* and 63*b* are connected to the brine branch circuits 61*a* and 61*b* disposed outside the freezers 30*a* and 30*b* through the contact part 62 to be attached to the freezers 30*a* and 30*b*.

The components of the cooling units 31*a* and 31*b* may be integrally formed in advance.

In the embodiment shown in FIG. 3, cooling units 32*a* and 32*b* are formed. The cooling units 32*a* and 32*b* are obtained by adding the brine branch circuits 78*a* and 78*b* branched from the brine circuit 60 and led into the cooling devices 33*a* and 33*b* to the cooling units 31*a* and 31*b*.

The brine branch circuits 78*a* and 78*b* are connected to the brine branch circuits 74*a* and 74*b* disposed outside the freezers 30*a* and 30*b* through the contact part 76 to be attached to the freezers 30*a* and 30*b*.

The components of the freezers 30*a* and 30*b* may be integrally formed in advance.

In an exemplary embodiment shown in FIG. 11, a cooling unit 93*a* is formed. The cooling unit 93*a* is obtained by adding the auxiliary heating electric heater 94*a* disposed on the back surfaces of the drain pans 50*a* and 50*b* to the cooling units 32*a* and 32*b*.

The components of the cooling unit 93*a* can be integrally formed in advance.

In the exemplary configuration of the cooling device 33*a* shown in FIG. 4 and FIG. 11, the drain pans 50*a* and 50*b* are inclined from the horizontal direction so that the drainage is discharged, and are respectively provided with drain outlet tubes 51*a* and 51*b* at the lower ends. Returning paths of the defrost circuits 52*a* and 52*b* are inclined along the back surfaces of the drain pans 50*a* and 50*b* in such a manner that a portion more on the downstream side is positioned higher.

The exemplary configurations of the cooling devices 33*a* and 33*b* are described. For example, in the cooling device 33*a* shown in FIG. 4 and FIG. 11, the heat exchanger pipe 42*a* includes headers 43*a* and 43*b* at the inlet tube 42*c* and the outlet tube 42*d* of the cooling device 33*a*, and is formed to have a winding shape in the upper and lower direction and the horizontal direction in the cooling device 33*a*. The defrost circuit 52*a* is disposed on the back surface of the drain pan 50*a*.

The brine branch circuit 78*a* has headers 80*a* and 80*b* disposed at an inlet and an outlet of the cooling device 33*a*. The defrost circuit 52*a* is disposed on the back surface of the drain pan 50*a* to be adjacent to the drain pan 50*a* and the brine branch circuit 63*a*, and is formed to have a winding shape in the horizontal direction.

A large number of plate fins 82*a* are disposed in the upper and lower direction in the cooling device 33*a*. The heat exchanger pipe 42*a* and the branch circuit 78*a* are inserted in a large number of holes formed on the plate fins 82*a* and thus are supported by the plate fins 82*a*. With the plate fins 82*a*, supporting strength for the heat exchanger pipe 42*a* and the brine branch circuit 78 is increased, and the heat transmission between the heat exchanger pipe 42*a* and the brine branch circuit 78*a* is facilitated.

The drain pan 50*a* is inclined from the horizontal direction, and is provided with the drain outlet tube 51*a* at a lower end. Return paths of the defrost circuit 52*a* and the brine branch circuit 63*a* are also inclined along the back surface of the drain pan 50*a*.

As described above, the return path of the defrost circuit 52*a* is inclined in such a manner that a portion more on the downstream side is positioned higher. Thus, the $CO_2$ refrigerant gas heated and vaporized by the brine b circulating in the brine branch circuit 63*a* can be favorably outgassed in the return path of the defrost circuit 52*a*. This can prevent a sudden pressure rise due to the vaporization of the $CO_2$ refrigerant.

In the exemplary configuration of the cooling device 33*a* shown in FIG. 4 and FIG. 11, the casing 34*a* is provided with an inlet opening and an outlet opening for air. For example, the inlet opening is formed on a side surface of the casing 34*a* and the outlet opening is formed on the upper surface of the casing 34*a*. Fans 35*a* and 35*b* are disposed at the outlet opening. When the fans 35*a* and 35*b* operate, the freezer inner air c forms an air flow flowing in and out of the casings 34*a* and 34*b*.

The cooling device 33*b* has a configuration that is similar to that of the cooling device 33*a*.

In the configuration of the present embodiment, the solenoid on-off valves 54*a* and 54*b* are opened and the solenoid on-off valves 55*a* and 55*b* are closed in the refrigerating operation. Thus, the $CO_2$ refrigerant supplied from the secondary refrigerant circuit 14 circulates in the $CO_2$ branch circuits 40*a* and 40*a* and the heat exchanger pipes 42*a* and 42*b*. The fans 35*a* and 35*b* form a circulation flow of the freezer inner air c passing in the cooling devices 33*a* and 33*b* inside the freezers 30*a* and 30*b*. The freezer inner air c is cooled by the $CO_2$ refrigerant circulating in the heat exchanger pipes 42*a* and 42*b*, whereby the internal temperature of the freezers 30*a* and 30*b* is kept as low as −25° C., for example.

The solenoid on-off valves 54*a* and 54*b* are closed and the solenoid on-off valves 55*a* and 55*b* are opened at the time of defrosting. Thus, the closed $CO_2$ circulation path including the heat exchanger pipes 42*a* and 42*b* and the defrost circuits 52*a* and 52*b* is formed. The pressure of the $CO_2$ refrigerant circulating in the closed circuit is adjusted with the pressure adjusting units 45*a* and 45*b* or the pressure adjusting unit 67 in such a manner that the condensing temperature of the $CO_2$ refrigerant circulating in the heat exchanger pipes 42*a* and 42*b* is adjusted to be at, for example, +5° C. (4.0 MPa) that is a temperature higher than the freezing point (for example, 0° C.) of the freezer inner air c.

The pressure adjusting units 45*a* and 45*b* may be provided with a temperature sensor that detects a temperature of the CO2 refrigerant instead of the pressure sensors 46*a* and 46*b*. Thus, the control devices 47*a* and 47*b* may convert the saturation pressure of the $CO_2$ refrigerant corresponding to the temperature detected value.

At the time of defrosting, frost attached to the surfaces of the heat exchanger pipes 42*a* and 42*b* is melted by the condensation latent heat (for example, 219 kJ/kg under +5° C./4.0 MPa when warm brine at +15° C. is used as the heating source) of the $CO_2$ refrigerant circulating in the heat exchanger pipes 42*a* and 42*b*, and drops onto the drain pans 50*a* and 50*b*.

The water as a result of the melting that has dropped onto the drain pans 50*a* and 50*b* is prevented from refreezing with the sensible heat of the brine circulating in the brine branch circuits 61*a* and 61*b* or 63*a* and 63*b* led to the drain pans 50*a* and 50*b*. Furthermore, heating and defrosting of the drain pans 50*a* and 50*b* can be achieved.

The $CO_2$ refrigerant circulating in the heat exchanger pipes 42*a* and 42*b* naturally circulate in the closed circuit by an effect of a looped thermosiphon obtained with, for example, the brine b at +15° C. used as the heating source and the frost attached on the surfaces of the heat exchanger pipes 42*a* and 42*b* used as a cooling source.

More specifically, in the embodiments shown in FIG. 1 and FIG. 6, the $CO_2$ refrigerant is heated by the brine in the heat exchangers 70*a* and 70*b*.

In the embodiments shown in FIG. 2, FIG. 3, and FIG. 9, the $CO_2$ refrigerant is heated and vaporized with the brine in the heat exchanger units formed on the back surfaces of the drain pans 50*a* and 50*b*. The $CO_2$ refrigerant gas vaporized in the heat exchanger units rises in the defrost circuits 52*a* and 52*b* to return to the heat exchanger pipes 42*a* and 42*b*, and melts the frost attached to the heat exchanger pipes 42*a* and 42*b* and is condensed. The condensed liquid CO2 refrigerant falls in the defrost circuits 52*a* and 52*b* with gravity, to be heated and vaporized again in the heat exchanger units.

The temperatures of the brine at the inlet and the outlet of the brine circuit 60 are detected by the temperature sensors 66 and 68. It is determined that the defrosting is completed when the difference between the detected values decreases so that the temperature difference reduces to a threshold value (for example, 2 to 3° C.), and thus the defrosting operation is terminated.

In some embodiments of the present invention, condensation latent heat of the $CO_2$ refrigerant with the condensing temperature exceeding the freezing point of the water vapor in the freezer inner air c is used to heat the frost attached to the heat exchanger pipes 42*a* and 42*b* from the inside of the heat exchanger pipes. Thus, a large amount of heat can be transmitted to the frost, and no heating means needs to be disposed outside the heat exchanger pipes 42*a* and 42*b*, whereby power saving and cost reduction can be achieved.

The $CO_2$ refrigerant is permitted to naturally circulate in the closed circuit by the thermosiphon effect. Thus, a power source such as a pump for circulating the $CO_2$ refrigerant is not required, and thus further power saving can be achieved.

With the condensing temperature of the $CO_2$ refrigerant at the time of defrosting kept at a temperature closer to the freezing point of the moisture content as much as possible, fogging can be prevented, and the thermal load can be lowered and the water vapor diffusion can be prevented as much as possible. The pressure of the $CO_2$ refrigerant can be reduced, whereby the pipes and the valves forming the closed circuit may be designed for lower pressure, whereby further cost reduction can be achieved.

The water as a result of the melting that has dropped onto the drain pans 50*a* and 50*b* can be prevented from defrosting by the sensible heat of the brine circulating in the brine branch circuits 61*a* and 61*b* or 63*a* and 63*b* led to the drain pans 50*a* and 50*b*. Furthermore, the drain pans 50*a* and 50*b* can be heated and defrosted by the sensible heat of the brine. Thus, no heater needs to be additionally provided to the drain pans 50*a* and 50*b*, whereby the cost reduction can be achieved.

According to the embodiments shown in FIG. 2, FIG. 3, and FIG. 9, the defrost circuits 52*a* and 52*b* and the brine branch circuits 63*a* and 63*b* form the heat exchanger units on the back surfaces of the drain pans 50*a* and 50*b*. Thus, the heating and defrosting of the drain pans 50*a* and 50*b* and the heating of the $CO_2$ refrigerant circulating in the defrost circuits 52*a* and 52*b* can be both achieved at the time of defrosting. Thus, no additional heater needs to be provided, whereby the cost reduction can be achieved.

According to the embodiments shown in FIG. 1 and FIG. 6, when the heat exchangers 70*a* and 70*b* are formed of, for example, a plate heat exchanger unit, which has high heat exchange efficiency, the efficiency of the heat exchange between the brine and the $CO_2$ refrigerant can be improved.

In the refrigeration apparatus 10C shown in FIG. 3 and the refrigeration apparatus 10D shown in FIG. 6, the brine branch circuits 74*a* and 74*b* or 78*a* and 78*b* are led into the freezers 30*a* and 30*b*, and the heat exchanger pipes 42*a* and 42*b* are heated from inside and outside. Thus, the heat exchanger pipes 42*a* and 42 can be effectively heated, and the defrosting time can be shortened.

With the cooling device 33*a* shown in FIG. 4 and FIG. 11, the heat is transmitted from the brine branch circuit 78*a* to the heat exchanger pipe 42*a* through the plate fins 82*a*, thus, the heat can be transmitted more efficiently. The brine branch circuit 78*a* and the heat exchanger pipe 42*a* are supported by the plate fins 82*a*, whereby the supporting strength for the pipes can be increased.

The difference between the detection values from the temperature sensors 66 and 68 is obtained, and a timing at which the difference between the detection values reduced to the threshold is determined as the timing at which the defrosting operation is completed. Thus, the timing at which the defrosting operation is completed can be accurately determined, whereby the excessive heating and the water vapor diffusion in the freezer can be prevented.

Thus, further power saving can be achieved, and the quality of the food products cooled in the freezers 30*a* and 30*b* can be improved with a more stable freezer inner temperature.

In some embodiments, the brine can be heated with the cooling water heated in the condenser 18 of the refrigerating device. Thus, no heating source is required outside the refrigeration apparatus.

The temperature of the cooling water can be reduced with the brine at the time of defrosting. Thus, the COP of the refrigerating device can be improved with the condensing temperature of the $NH_3$ refrigerant at the time of the refrigerating operation lowered.

Furthermore, in the exemplary configuration where the cooling water circuit 28 is disposed between the condenser 18 and the cooling tower 26, the heat exchanger unit 58 can be disposed in the cooling tower. Thus, the installation space for the device used for the defrosting can be downsized.

With the refrigeration apparatus 10E shown in FIG. 9, in the closed-type cooling and heating unit 90, the brine can be heated with the spray water that has absorbed the sensible heat of the cooling water. Thus, the heat exchanger unit 58 is no longer required, and by integrating the heating tower 91 and the cooling tower 26, the installation space can be downsized.

By using the spray water in the closed-type cooling tower 26 as the heat source for the brine, the heat can also be acquired from the outer air. When the refrigeration apparatus 10E employs an air cooling system, the cooling water can be cooled and the brine can be heated with the outer air as the heat source, with the heating tower alone.

A plurality of the closed-type cooling towers 26, incorporated in the closed-type cooling and heating unit 90, may be laterally coupled in parallel to be installed.

In some embodiments, the pressure adjusting units 45*a* and 45*b* adjust pressure of in the closed circuit, whereby the pressure adjusting units can be simplified and can be provided with a low cost.

In the embodiment shown in FIG. 10, the pressure adjusting unit 67 is provided. Thus, the pressure adjusting unit needs not to be provided for each cooling device, and only a single pressure adjusting unit needs to be provided. Thus, the cost reduction can be achieved, and the pressure in the closed circuit can be easily adjusted with the pressure in the closed circuit adjusted from the outside of the freezer.

In the cooling device 33*a* shown in FIG. 11, the drain pans 50*a* and 50*b* are provided with the auxiliary heating electric heater 94*a*. Thus, the drainage stored in the drain pans 50*a* and 50*b* can be prevented from refreezing. Even when the amount of heat of the brine circulating in the brine branch circuits falls short, the auxiliary heating electric heater 94*a* can add the vaporization heat of the $CO_2$ refrigerant circulating in the defrost circuits 52*a* and 52*b*, when the heat exchanger units formed of the defrost circuits 52*a* and 52*b* and the brine branch circuits 61*a* and 61*b* or 63*a* and 63*b* are formed on the drain pans 50*a* and 50*b*.

In the embodiments shown in FIG. 2 and FIG. 9, the cooling units 31*a* and 31*b* are formed. Thus, the freezers 30*a* and 30*b* with defrosting devices can be easily attached to the freezers 30*a* and 30*b*. When the components of the cooling units 31*a* and 31*b* are integrally assembled, the freezers 30*a* and 30*b* can be more easily attached.

According to the embodiment shown in FIG. 3, the cooling units 32*a* and 32*b* are formed. Thus, the heat exchanger pipes 42*a* and 42*b* can be heated from both inner and outer sides at the time of defrosting. Thus, the cooling devices with the defrosting devices exerting high heating effect can be attached easily.

When the components of the cooling units 31*a* and 31*b* are integrally assembled, the cooling devices can be more easily attached According to the embodiment shown in FIG. 11, the cooling unit 93*a* provided with the auxiliary heating electric heater 94*a* is formed. Thus, the cooling devices with the defrosting devices which can auxiliary heat the CO2 refrigerant circulating in the defrost circuits 52*a* and 52*b* led to the drain pans, as well as the drain pans 50*a* and 50*b*, can be easily attached.

The configurations of some embodiments are described above. The embodiments can be combined as appropriate in accordance with an object and a purpose of the refrigeration apparatus.

INDUSTRIAL APPLICABILITY

According to the present invention, reduction in initial and running costs required for defrosting a refrigeration apparatus used for forming a freezer and other cooling spaces and power saving can be achieved.

REFERENCE SIGNS LIST

10A, 10B, 10C, 10D, 10E, 10F refrigeration apparatus
11A, 11B, 11C, 11D refrigerating device
12 primary refrigerant circuit
14 secondary refrigerant circuit
16 compressor
16*a* higher stage compressor
16*b* lower stage compressor
18 condenser
20 liquid $NH_3$ receiver
22, 22*a*, 22*b* expansion valve
24 cascade condenser
26 closed-type cooling tower
28 cooling water circuit
29, 57 cooling water pump
30, 30*a*, 30*b* freezer
31*a*, 31*b*, 32*a*, 32*b*, 93*a* cooling unit
33, 33*a*, 33*b* cooling device
34*a*, 34*b* casing
35*a*, 35*b* fan
36 liquid CO2 receiver
38 liquid $CO_2$ pump
40*a*, 40*b* $CO_2$ branch circuit
41, 62, 76 contact part
42*a*, 42*b* heat exchanger pipe
42*a* inlet tube
42*d* outlet tube
43*a*, 43*b*, 80*a*, 80*b* header
44 $CO_2$ circulation path
45*a*, 45*b*, 67 pressure adjusting unit
46*a*, 46*b* pressure sensor
47*a*, 47*b*, 67*c* control device
48*a*, 48*b* pressure adjustment valve
50*a*, 50*b* drain pan
51*a*, 51*b* drain outlet tube
52*a*, 52*b* defrost circuit
54*a*, 54*b*, 55*a*, 55*b* solenoid on-off valve
56 cooling water branch circuit
58 heat exchanger unit (second heat exchanger unit)
60 brine circuit
61*a*, 61*b*, 63*a*, 63*b*, 72*a*, 72*b*, 74*a*, 74*b*, 78*a*, 78*b* brine branch circuit
64 receiver
65 brine pump
66, 68 temperature sensor
70*a*, 70*b* heat exchanger unit (first heat exchanger unit)
82*a* plate fin
86 intermediate expansion valve
84 intermediate cooling device
88*a* higher temperature compressor
88*b* lower temperature compressor
90 closed-type cooling and heating unit
91 closed-type heating tower
92 expansion tank
94*a* auxiliary heating electric heater
a outer air
b brine
c freezer inner air

The invention claimed is:

1. A defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy $CO_2$ refrigerant; and a refrigerant circuit connected to the heat exchanger pipe, for permitting the $CO_2$ refrigerant cooled and liquefied by the refrigerating device to circulate to the heat exchanger pipe, the defrost system comprising:

a defrost circuit which is branched from an inlet path and an outlet path of the heat exchanger pipe and forms a $CO_2$ circulation path together with the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting valve configured to adjust a pressure of the $CO_2$ refrigerant circulating in the closed circuit at the time of defrosting; and a first heat exchanger configured to heat the $CO_2$ refrigerant circulating in the defrost circuit with brine, disposed below the cooling device and to which the defrost circuit and a first brine circuit, in which the brine as a first heating medium circulates, are led, wherein the $CO_2$ refrigerant is permitted to naturally circulate in the closed circuit at the time of defrosting by a thermosiphon effect, wherein the defrost system further comprises a second heat exchanger configured to heat the brine with a second heating medium, wherein the first brine circuit is disposed between the first heat exchanger and the second heat exchanger, and wherein the first brine circuit includes a second brine circuit led to the drain receiver unit.

2. A defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy $CO_2$ refrigerant; and a refrigerant circuit connected to the heat exchanger pipe, for permitting the $CO_2$ refrigerant cooled and liquefied by the refrigerating device to circulate to the heat exchanger pipe, the defrost system comprising:

a defrost circuit which is branched from an inlet path and an outlet path of the heat exchanger pipe and forms a $CO_2$ circulation path together with the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting valve configured to adjust a pressure of the $CO_2$ refrigerant circulating in the closed circuit at the time of defrosting; and a first heat exchanger configured to heat the $CO_2$ refrigerant circulating in the defrost circuit with brine, disposed below the cooling device and to which the defrost circuit and a first brine circuit, in which the brine as a first heating medium circulates, are led, wherein the $CO_2$ refrigerant is permitted to naturally circulate in the closed circuit at the time of defrosting by a thermosiphon effect, wherein the defrost system further comprises a second heat exchanger configured to heat the brine with a second heating medium, wherein the first brine circuit is disposed between the first heat exchanger and the second heat exchanger, wherein the defrost circuit and the first brine circuit are led to the drain receiver unit, wherein the first heat exchanger includes the defrost circuit led to the drain receiver unit and the first brine circuit led to the drain receiver unit, and wherein the defrost system is configured to heat the drain receiver unit and the $CO_2$ refrigerant in the defrost circuit with the brine circulating in the first brine circuit.

3. A defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy CO2 refrigerant; and a refrigerant circuit connected to the heat exchanger pipe, for permitting the CO2 refrigerant cooled and liquefied by the refrigerating device to circulate to the heat exchanger pipe, the defrost system comprising:

a defrost circuit which is branched from an inlet path and an outlet path of the heat exchanger pipe and forms a CO2 circulation path together with the heat exchanger pipe;

an on-off valve disposed in each of the inlet path and the outlet path of the heat exchanger pipe and configured to be closed at a time of defrosting so that the CO2 circulation path becomes a closed circuit;

a pressure adjusting valve configured to adjust a pressure of the CO2 refrigerant circulating in the closed circuit at the time of defrosting; and a first heat exchanger configured to heat the CO2 refrigerant circulating in the defrost circuit with brine, disposed below the cooling device and to which the defrost circuit and a first brine circuit, in which the brine as a first heating medium circulates, are led, wherein the CO2 refrigerant is permitted to naturally circulate in the closed circuit at the time of defrosting by a thermosiphon effect, and wherein the defrost system further includes a second brine circuit branched from the first brine circuit and led into the cooling device, configured to heat the $CO_2$ refrigerant circulating in the heat exchanger pipe with the brine.

4. The defrost system for the refrigeration apparatus according to claim 1, further comprising a first temperature sensor and a second temperature sensor which are respectively disposed at an inlet and an outlet of the first brine circuit, for detecting a temperature of the brine flowing through the inlet and the outlet.

5. The defrost system for the refrigeration apparatus according to claim 1, wherein the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver configured to store the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit.

6. The defrost system for the refrigeration apparatus according to claim 1, wherein the refrigerating device is a $NH_3/CO_2$ cascade refrigerating device including:

a primary refrigerant circuit in which $NH_3$ refrigerant circulates and a first refrigerating cycle component is disposed; and a secondary refrigerant circuit in which the $CO_2$ refrigerant circulates and a second refrigerating cycle component is disposed, the secondary refrigerant circuit led to the cooling device, the secondary refrigerant circuit being connected to the primary refrigerant circuit through a cascade condenser.

7. A defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy $CO_2$ refrigerant; and a refrigerant circuit connected to the heat exchanger pipe, for permitting the $CO_2$ refrigerant cooled and liquefied by the refrigerating device to circulate to the heat exchanger pipe, the defrost system comprising:

a defrost circuit which is branched from an inlet path and an outlet path of the heat exchanger pipe and forms a $CO_2$ circulation path together with the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting valve configured to adjust a pressure of the $CO_2$ refrigerant circulating in the closed circuit at the time of defrosting;

a first heat exchanger configured to heat the $CO_2$ refrigerant circulating in the defrost circuit with brine, disposed below the cooling device and to which the defrost circuit and a first brine circuit, in which the brine as a first heating medium circulates, are led; and a second heat exchanger configured to heat the brine with a second heating medium, wherein the $CO_2$ refrigerant is permitted to naturally circulate in the closed circuit at the time of defrosting by a thermosiphon effect, wherein the first brine circuit is disposed between the first heat exchanger and the second heat exchanger, wherein the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver configured to store the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit, wherein the defrost system further includes a cooling water circuit led to a condenser as a part of the refrigerating cycle component disposed in the primary refrigerant circuit, and wherein the cooling water circuit and the first brine circuit are led to the second heat exchanger for heating the brine circulating in the first brine circuit with cooling water circulating in the cooling water circuit and having been heated in the condenser.

8. A defrost system for a refrigeration apparatus including: a cooling device which is disposed in a freezer, and includes a casing, a heat exchanger pipe led into the casing, and a drain receiver unit disposed below the heat exchanger pipe; a refrigerating device configured to cool and liquefy $CO_2$ refrigerant; and a refrigerant circuit connected to the heat exchanger pipe, for permitting the $CO_2$ refrigerant cooled and liquefied by the refrigerating device to circulate to the heat exchanger pipe, the defrost system comprising:

a defrost circuit which is branched from an inlet path and an outlet path of the heat exchanger pipe and forms a $CO_2$ circulation path together with the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting valve configured to adjust a pressure of the $CO_2$ refrigerant circulating in the closed circuit at the time of defrosting;

a first heat exchanger configured to heat the $CO_2$ refrigerant circulating in the defrost circuit with brine, disposed below the cooling device and to which the defrost circuit and a first brine circuit, in which the brine as a first heating medium circulates, are led; and a second heat exchanger configured to heat the brine with a second heating medium, wherein the $CO_2$ refrigerant is permitted to naturally circulate in the closed circuit at the time of defrosting by a thermosiphon effect, wherein the first brine circuit is disposed between the first heat exchanger and the second heat exchanger, wherein the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver configured to store the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit, wherein the defrost system further includes a cooling water circuit led to a condenser as a part of the refrigerating cycle component disposed in the primary refrigerant circuit, and wherein the second heat exchanger includes:

a cooling tower for cooling cooling water circulating in the cooling water circuit with spray water; and a heating tower for receiving the spray water and heating the brine circulating in the first brine circuit with the spray water.

9. The defrost system for the refrigeration apparatus according to claim 1, wherein the pressure adjusting valve is disposed in the outlet path of the heat exchanger pipe.

10. The defrost system for the refrigeration apparatus according to claim 1, wherein the drain receiver unit further includes an auxiliary heating electric heater.

11. A cooling unit comprising:

a cooling device which includes:

a casing;

a heat exchanger pipe led into the casing; and a drain pan disposed below the heat exchanger pipe;

a defrost circuit which is branched from an inlet path and an outlet path of the heat exchanger pipe and forms a $CO_2$ circulation path together with the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting valve configured to adjust pressure of the $CO_2$ refrigerant circulating in the closed circuit at the time of defrosting;

a heat exchanger that includes the defrost circuit led to the drain pan and a first brine circuit led to the drain pan, and configured to heat the drain receiver unit with the brine circulating in the first brine circuit; and a second brine circuit branched from the first brine circuit and led into the cooling device, for heating the CO2 refrigerant circulating in the heat exchanger pipe with the brine.

* * * * *